US007279273B2

(12) United States Patent
Fukui

(10) Patent No.: US 7,279,273 B2
(45) Date of Patent: Oct. 9, 2007

(54) PHOTOTHERMOGRAPHIC MATERIAL

(75) Inventor: Kouta Fukui, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/506,807

(22) Filed: Aug. 21, 2006

(65) Prior Publication Data

US 2007/0072135 A1 Mar. 29, 2007

(30) Foreign Application Priority Data

Sep. 22, 2005 (JP) ..... 2005-276105

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/631

(58) Field of Classification Search ..... 430/617–620, 430/631
See application file for complete search history.

(56) References Cited

U.S. PATENT DOCUMENTS

2006/0057508 A1* 3/2006 Fukui et al. ..... 430/348

FOREIGN PATENT DOCUMENTS

JP A 11-352624 12/1999

* cited by examiner

*Primary Examiner*—Geraldina Visconti
(74) *Attorney, Agent, or Firm*—Margaret A. Burke; Sheldon J. Moss

(57) ABSTRACT

The present invention provides a photothermographic material having, on at least one side of a support, an image forming layer including at least a photosensitive silver halide, a first non-photosensitive organic silver salt, a reducing agent, and a binder, and a non-photosensitive layer including a second non-photosensitive organic silver salt that is different from the first non-photosensitive organic silver salt on the same side of the support as the image forming layer and farther from the support than the image forming layer, wherein the photothermographic material further has a non-photosensitive intermediate layer between the image forming layer and the non-photosensitive layer, and 50% by weight or more of a binder in the non-photosensitive intermediate layer is a polymer latex. A photothermographic material, which exhibits improved image storability and improved resistance to image defects, is provided.

10 Claims, No Drawings

PHOTOTHERMOGRAPHIC MATERIAL

CROSS-REFERENCE TO RELATED APPLICATION

This application claims priority under 35 USC 119 from Japanese Patent Application No. 2005-276105, the disclosure of which is incorporated by reference herein.

BACKGROUND OF THE INVENTION

1. Field of the Invention

The present invention relates to a photothermographic material. More particularly, the invention relates to a photothermographic material which exhibits improved image storability and improved resistance to image defects.

2. Description of the Related Art

In recent years, in the field of films for medical diagnosis and in the field of films for graphic arts, there has been a strong desire for decreasing the amount of processing liquid waste from the viewpoints of protecting the environment and economy of space. For this reason, technology regarding thermal developing image recording materials for medical diagnosis and for graphic arts, which can be exposed effectively by laser image setters or laser imagers and thermally developed to obtain clear black-toned images of high resolution and sharpness, is required. The thermal developing image recording materials do not require liquid processing chemicals and can therefore be supplied to customers as a simpler and environmentally friendly thermal processing system.

While similar requirements also exist in the field of general image recording materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are described, for example, in the specifications of U.S. Pat. Nos. 3,152,904 and 3,457,075 and in "Thermally Processed Silver Systems" by D. Klosterboer, appearing in "Imaging Processes and Materials", Neblette, 8th edition, edited by J. Sturge, V. Warlworth, and A. Shepp, Chapter 9, pages 279 to 291, 1989. All patents, patent publications, and non-patent literature cited in this specification are hereby expressly incorporated by reference herein.

In particular, photothermographic materials generally have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

Most conventional photothermographic materials have been generally produced by a process using an organic solvent such as toluene, methyl ethyl ketone, or methanol as a solvent. However, the use of an organic solvent as the solvent is not advantageous, not only in view of undesired effects on the human body during the manufacturing process, but also in view of the cost due to recovery of used solvents and other factors.

In view of the above, a manufacturing method using an aqueous dispersion of a hydrophobic polymer as a binder has been disclosed in Japanese Patent Application Laid-Open (JP-A) No. 10-10670 as a method of manufacturing a photothermographic material using a coating solution of an aqueous medium which does not require such concern. Further, JP-A No. 11-84573 discloses the use of a specified polymer latex as a binder of a surface protective layer.

These photothermographic materials utilizing an organic silver salt have a great characteristic of containing all components necessary for image formation in the film in advance and being capable of forming images only by heating. However, there is a problem in that it is difficult to adjust the color tone of a developed silver image to be favorable. Furthermore, because these components remain as unreacted components or reaction products after image formation, there is another problem in that these remaining components and reaction products exert adverse influences on storage stability of the image.

Further, in the manufacturing method using the aqueous dispersion of the hydrophobic polymer described above as a binder, since a styrene-butadiene polymer which is a raw material for synthetic rubbers is used as a polymer for use in the binder, the film quality is soft, and improvement has been demanded with respect to forces such as pressure, scratching, and the like.

SUMMARY OF THE INVENTION

The present invention has been made in view of the above circumstances and provides a photothermographic material comprising, on at least one side of a support, an image forming layer comprising at least a photosensitive silver halide, a first non-photosensitive organic silver salt, a reducing agent, and a binder, and a non-photosensitive layer comprising a second non-photosensitive organic silver salt that is different from the first non-photosensitive organic silver salt on the same side of the support as the image forming layer and farther from the support than the image forming layer, wherein the photothermographic material further comprises a non-photosensitive intermediate layer between the image forming layer and the non-photosensitive layer, and 50% by weight or more of a binder in the non-photosensitive intermediate layer is a polymer latex.

DETAILED DESCRIPTION OF THE INVENTION

An object of the present invention is to provide a photothermographic material which exhibits improved image storability and improved resistance to image defects.

The present invention is described in detail below.

The photothermographic material of the present invention is characterized in that it has, on at least one side of a support, an image forming layer including at least a photosensitive silver halide, a first non-photosensitive organic silver salt, a reducing agent, and a binder, and a non-photosensitive layer including a second non-photosensitive organic silver salt, which is different from the first non-photosensitive organic silver salt, on the same side of the support as the image forming layer and farther from the support than the image forming layer, wherein the photothermographic material further has a non-photosensitive intermediate layer between the image forming layer and the non-photosensitive layer, and 50% by weight or more of a binder in the non-photosensitive intermediate layer is a polymer latex.

Preferably, the first non-photosensitive organic silver salt is a silver salt of a fatty acid, and the second non-photosensitive organic silver salt is a silver salt of a nitrogen-containing heterocyclic compound. More preferably, the silver salt of a nitrogen-containing heterocyclic compound is a silver salt of a benzotriazole compound.

Preferably, a ratio of an amount of the second non-photosensitive organic silver salt relative to an amount of the first non-photosensitive organic silver salt is from 0.5 mol % to 50 mol % on the basis of silver molar ratio.

Preferably, 50% by weight or more of the binder in the image forming layer is a polymer latex.

Preferably, the photothermographic material has an outermost layer that is different from the non-photosensitive layer, on the side of the support having thereon the image forming layer. More preferably, 50% by weight or more of a binder in the outermost layer is a hydrophilic polymer. Even more preferably, the hydrophilic polymer is gelatin or a gelatin derivative.

Preferably, the photothermographic material contains a polymer latex having a monomer component represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 to 41 fluorine atoms; p represents 1 or 2; L represents a linking group containing 1 to 12 carbon atoms; and R represents a hydrogen atom or a methyl group.

Preferably, the polymer latex having a monomer component represented by formula (P) is incorporated in the outermost layer on the side of the support having thereon the image forming layer.

By the means mentioned above, image storage stability of the photothermographic material is improved, and resistance to image defects is improved.

(Second Non-Photosensitive Organic Silver Salt Incorporated in Non-Photosensitive Layer)

The second non-photosensitive organic silver salt incorporated in the non-photosensitive layer according to the present invention is preferably a silver salt of a nitrogen-containing heterocyclic compound.

The non-photosensitive layer containing the second non-photosensitive organic silver salt mentioned above is at least one non-photosensitive layer which is disposed on the same side of the support as the image forming layer and farther from the support than the image forming layer, and includes a surface protective layer, an intermediate layer between the surface protective layer and the image forming layer, and the like, which are described below. The second non-photosensitive organic silver salt is preferably included in at least one layer of these non-photosensitive layers.

Concerning the silver salt of a nitrogen-containing heterocyclic compound, specific examples of the nitrogen-containing heterocyclic compound include, but are not limited to these examples, azoles, oxazoles, thiazoles, thiazolines, imidazoles, diazoles, pyridines, indolizines, and triazines. Among them, preferred are indolizines, imidazoles, and azoles. Preferred examples of azoles include triazole, tetrazole, and their derivatives. More preferred are benzimidazoles and derivatives thereof, and benzotriazole and derivatives thereof. Preferred example of indolizines is a triazaindolizine derivative.

Representative examples of the nitrogen-containing heterocyclic compound further include, but are not limited to these examples, 1,2,4-triazole, benzotriazoles and derivatives thereof; and preferred are benzotriazole, methylbenzotriazole, and 5-chlorobenzotriazole. Further, 1H-tetrazole compounds such as phenylmercaptotetrazole described in U.S. Pat. No. 4,220,709 (de Mauriac), and imidazole and imidazole derivatives described in U.S. Pat. No. 4,260,677 (Winslow, et al) can be described, and benzimidazole and nitrobenzimidazole are preferred. As a triazaindolizine derivative, preferred is 5-methyl-7-hydroxy-1,3,5-triazaindolizine, but the invention is not limited to the compound.

It is characteristic that a mean equivalent circular diameter of particles of the second non-photosensitive organic silver salt according to the present invention is in a range of from 0.03 μm to 0.5 μm. It is preferably in a range of from 0.05 μm to 0.4 μm, and more preferably from 0.08 μm to 0.3 μm.

When the mean equivalent circular diameter is smaller than 0.03 μm, solution or aggregation occurs during storage of the dispersion and coarse particles are formed. Therefore, the production becomes so unstable that the desired performance can not be attained. When the mean equivalent circular diameter is larger than 0.5 μm, even if particles are stable in their range, the second non-photosensitive organic silver salt can not provide the excepted inherent effects.

Concerning method for measuring the particle size of organic silver salt, the area of a particle is calculated from projected area of individual particles by observation through electron microscope, and thereafter the equivalent circular diameter is determined by converting the area to a circle having the area equivalent to the obtained area.

In order to control the mean equivalent circular diameter of the second non-photosensitive organic silver salt according to the present invention to be in the above range, condition of preparing the organic silver salt crystals and condition of dispersing them can be utilized.

<<Preparing Process of Second Non-Photosensitive Organic Silver Salt Crystals>>

The second non-photosensitive organic silver salt crystals used in the present invention can be prepared according to the conventional synthesis method. For example, preparation is carried out by melting an organic compound in water on heating above the melting point (generally from 10° C. to 90° C.) and forming a sodium salt thereof by using sodium hydroxide, and then an aqueous solution of silver nitrate is added to deposit an organic silver salt. Alternatively, in the case where an alkali metal salt thereof has high water solubility, an aqueous solution of sodium salt, potassium salt, or lithium salt is prepared by using sodium hydroxide, potassium hydroxide, or lithium hydroxide respectively, and then the aqueous solution of the alkali metal salt is mixed with an aqueous solution of silver nitrate to deposit the silver salt crystal. Depending on needs, it is preferred to perform desalting treatment. During the preparation of the crystal, the presence of hydrophilic colloid such as gelatin, modified poly(vinyl alcohol), or the like is preferred. Soft structured crystals which are easily dispersed finely in a dispersing process described below are preferably prepared by adjusting the concentration of each chemical, the mixing temperature, and the mixing speed.

As the particle size distribution of the second organic silver salt, monodispersion is preferred. In order to attain monodispersed distribution, the non-photosensitive organic silver salt is preferably prepared by mixing an aqueous solution of alkali metal salt of an organic compound with an aqueous solution of silver nitrate by a simultaneous adding method.

The reaction temperature at the addition in the case of preparation by the simultaneous adding method is preferably in a range of from 30° C. to 95° C., and more preferably from 50° C. to 90° C. to attain the particle size range required in the present invention. When the reaction temperature is too low, the particle size of the obtained organic silver salt is so small that storage stability is deteriorated, and it is not preferred. On the other hand, when the reaction temperature is too high, the particle size of the obtained organic silver salt is so large that the expected effects can not be obtained, and it is not preferred.

<<Dispersing Process>>

It is preferred to disperse the crystals in the moist slurry state after crystal preparation in view of preparing fine particle dispersion. During the dispersing process, the use of a suitable dispersing agent is preferred. As the dispersing method, various dispersing methods described in the explanation of reducing agent of the present invention can be applied. Among these, solid dispersing method is most preferred. Specific example of the synthesis method is described in JP-A No. 1-100177.

The addition amount of the second non-photosensitive organic silver salt incorporated in the non-photosensitive layer is from 0.001 $g/m^2$ to 3 $g/m^2$, in terms of a silver amount, more preferably from 0.005 $g/m^2$ to 1 $g/m^2$, and even more preferably from 0.01 $g/m^2$ to 0.5 $g/m^2$.

The amount of the second non-photosensitive organic silver salt incorporated in the non-photosensitive layer is preferably from 0.5 mol % to 50 mol %, and more preferably from 1 mol % to 20 mol %, with respect to the first non-photosensitive organic silver salt added in the image forming layer.

(First Non-Photosensitive Organic Silver Salt Incorporated in Image Forming Layer)

1) Composition

The non-photosensitive organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), European Patent (EP) No. 803,764A1 (page 18, line 24 to page 19, line 37), EP No. 962,812A1, JP-A Nos. 11-349591, 2000-7683, and 2000-72711, and the like. A silver salt of an organic acid, particularly, a silver salt of a long-chained aliphatic carboxylic acid (having 10 to 30 carbon atoms, and preferably having 15 to 28 carbon atoms) is preferable. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably 85 mol % or higher, and even more preferably 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cubic, or potato-like indefinite shaped particles with the major axis to minor axis ratio being lower than 5 are also used preferably. Such organic silver salt particles suffer less from fogging during thermal development compared with long needle-like particles with the major axis to minor axis length ratio of 5 or higher. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of a particle of the organic silver salt to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake shaped particle is preferably from 1.1 to 30 and, more preferably, from 1.1 to 15 with a viewpoint of causing less agglomeration in the photothermographic material and improving image storability.

As the particle size distribution of the organic silver salt, monodispersion is preferred. In the monodispersion, the percentage for the value obtained by dividing the standard deviation for the length of minor axis and major axis by the minor axis and the major axis respectively is preferably 100% or less, more preferably 80% or less and, even more preferably 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient) is preferably 100% or less, more preferably 80% or less and, even more preferably 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 803,763A1 and 962,812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be manufactured by mixing an aqueous dispersion of the organic silver salt and an aqueous dispersion of a photosensitive silver salt, and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably from 2 mol % to 20 mol % and, particularly preferably from 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt of the invention can be used in a desired amount, a total amount of coated silver including silver halide is preferably in a range of from 0.1 g/m$^2$ to 5.0 g/m$^2$, more preferably from 0.3 g/m$^2$ to 3.0 g/m$^2$, and even more preferably from 0.5 g/m$^2$ to 2.0 g/m$^2$. In particular, in order to improve image storability, the total amount of coated silver is preferably 1.8 mg/m$^2$ or less, and more preferably 1.6 mg/m$^2$ or less.

(Reducing Agent)

The photothermographic material of the present invention preferably contains a reducing agent for organic silver salts as a thermal developing agent. The reducing agent for organic silver salts can be any substance (preferably, organic substance) which reduces silver ions into metallic silver. Examples of the reducing agent are described in JP-A No. 11-65021 (column Nos. 0043 to 0045) and EP No. 803,764A1 (p. 7, line 34 to p. 18, line 12).

The reducing agent according to the invention is preferably a so-called hindered phenolic reducing agent or a bisphenol agent having a substituent at the ortho-position with respect to the phenolic hydroxy group. It is more preferably a compound represented by the following formula (R).

Formula (R)

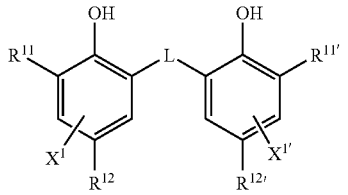

In formula (R), $R^{11}$ and $R^{11'}$ each independently represent an alkyl group having 1 to 20 carbon atoms. $R^{12}$ and $R^{12'}$ each independently represent a hydrogen atom or a substituent which substitutes for a hydrogen atom on a benzene ring. L represents an —S— group or a —CHR$^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

In the following description, when referred an alkyl group, it means that the alkyl group contains a cycloalkyl group, unless otherwise specified.

1) $R^{11}$ and $R^{11'}$ $R^{11}$ and $R^{11'}$ each independently represent a substituted or unsubstituted alkyl group having 1 to 20 carbon atoms.

The substituent for the alkyl group has no particular restriction and include, preferably, an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a substituent which substitutes for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —CHR$^{13}$— group. $R^{13}$ represents a hydrogen atom or an alkyl group having 1 to 20 carbon atoms in which the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group include, similar to the substituent of $R^{11}$, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and examples thereof include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are even more preferred and, a methyl group and a t-butyl group being most preferred.

$R^{12}$ and $R^{12'}$ are preferably an alkyl group having 1 to 20 carbon atoms and examples thereof include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group include a methyl group, an ethyl group, a propyl group, an isopropyl group, a 2,4,4-trimethylpentyl group, a cyclohexyl group, a 2,4-dimethyl-3-cyclohexenyl group, a 3,5-dimethyl-3-cyclohexenyl group, and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performance, color tone of developed silver images, or the like depending on the combination of $R^{11}$, $R^{11'}$, $R^{12}$, $R^{12'}$, and $R^{13}$. Since the performance can be controlled by using two or more reducing agents in combination, it is preferred to use two or more reducing agents in combination depending on the purpose.

Specific examples of the reducing agent of the invention including the compounds represented by formula (R) according to the invention are shown below, but the invention is not restricted to these.

R-1

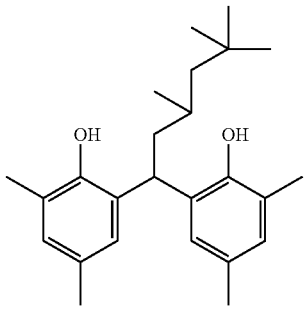

R-2

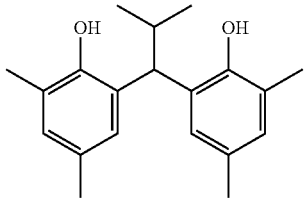

R-3

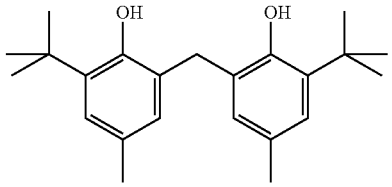

R-4

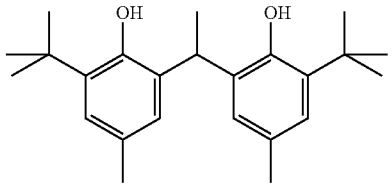

R-5

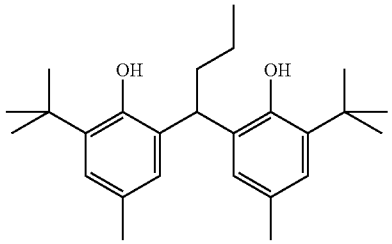

R-6

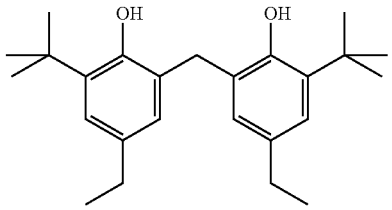

R-7

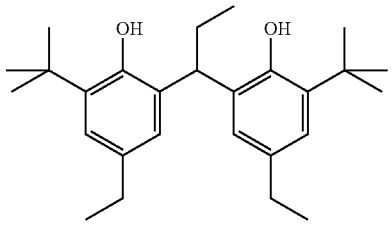

-continued

R-8

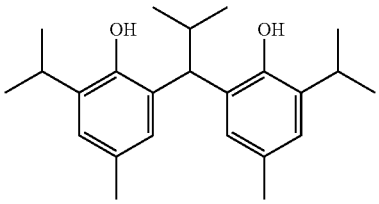

R-9

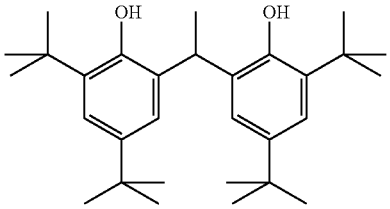

R-10

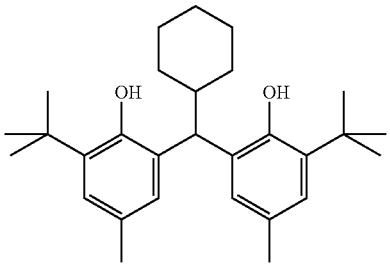

R-11

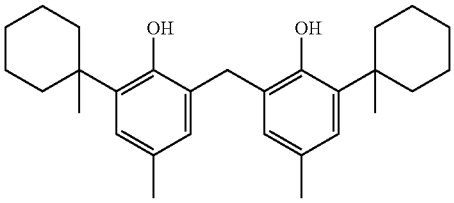

R-12

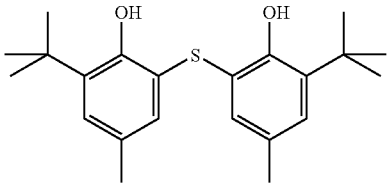

R-13

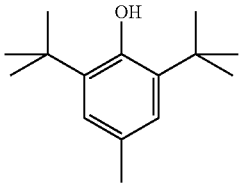

R-14

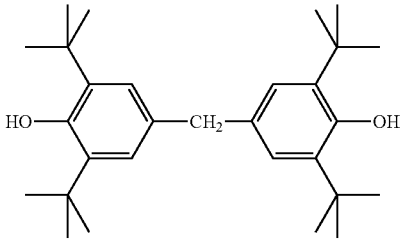

-continued

R-15

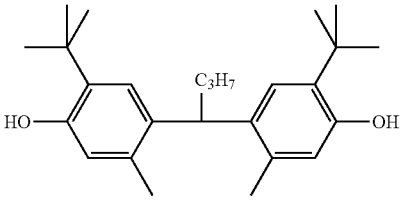

R-16

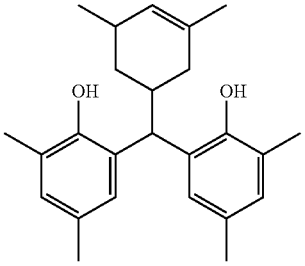

R-17

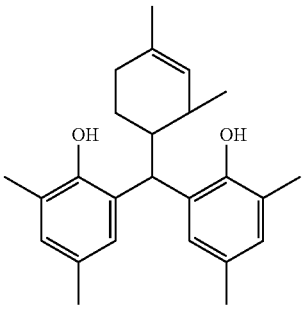

R-18

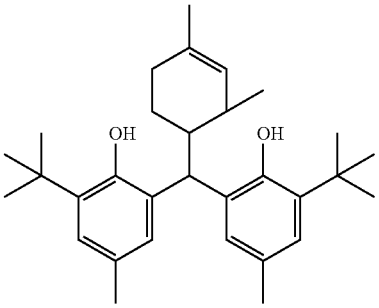

As preferred examples of the reducing agent of the invention other than those shown above, there are mentioned compounds disclosed in JP-A Nos. 2001-188314, 2001-209145, 2001-350235, and 2002-156727, and EP No. 1,278,101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into the photothermographic material by being added into the coating solution, such as in the form of a solution, an emulsified dispersion, a solid fine particle dispersion, or the like.

As well known emulsion dispersing method, there is mentioned a method comprising dissolving the reducing agent in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there is mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining a solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as a solid particle dispersion, and is added in the form of fine particles having a mean particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, it is preferred to use a developing accelerator. As a development accelerator, sulfonamido phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable. The development accelerator is used in a range of from 0.1 mol % to 20 mol %, preferably in a range of from 0.5 mol % to 10 mol % and, more preferably in a range of from 1 mol % to 5 mol %, with respect to the reducing agent. The introducing methods to the photothermographic material include similar methods as those for the reducing agent and, it is particularly preferred to add as a solid dispersion or an emulsified dispersion. In the case of adding as an emulsified dispersion, it is preferred to add as an emulsified dispersion dispersed by using a solvent having a high boiling point which is solid at a normal temperature and an auxiliary solvent having a low boiling point, or to add as a so-called oilless emulsified dispersion not using a solvent having a high boiling point.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$Q_1$-NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which rings described above are condensed to each other are also preferred.

The rings described above may have substituents and in the case where they have two or more substituents, the substituents may be identical or different from one another. Examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms, and more preferably having 6 to 40 carbon atoms; and examples thereof include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group preferably having 1 to 50 carbon atoms, and more preferably having 6 to 40 carbon atoms; and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group preferably having 2 to 50 carbon atoms, and more preferably having 6 to 40 carbon atoms; and example thereof include methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms, and more preferably having 7 to 40 carbon atoms; and examples thereof include phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms, and more preferably having 6 to 40 carbon atoms; and examples thereof include methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group preferably having 0 to 50 carbon atoms, and more preferably having 6 to 40 carbon atoms; and examples thereof include unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which a ring described above is condensed with a benzene ring or unsaturated heterocycle are more preferred. Further, $Q_2$ is preferably a carbamoyl group and, particularly, a carbamoyl group having a hydrogen atom on the nitrogen atom is particularly preferred.

Formula (A-2)

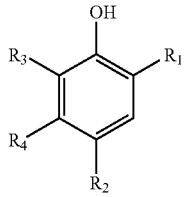

In formula (A-2), $R_1$ represents one selected from an alkyl group, an acyl group, an acylamino group, a sulfonamido group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R^1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A - 1

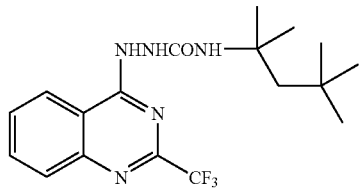

A - 2

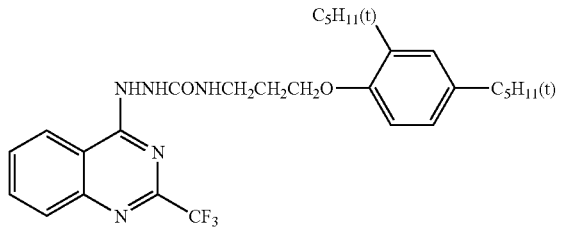

-continued

A - 3

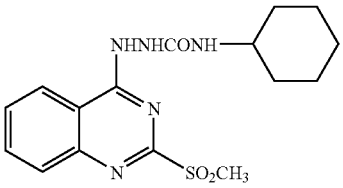

A - 4

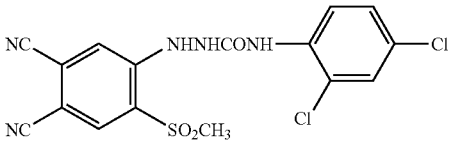

A - 5

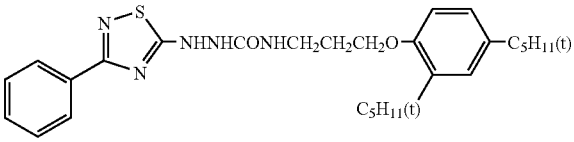

A - 6

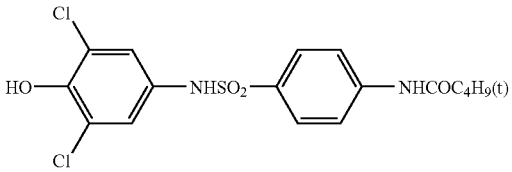

A - 7

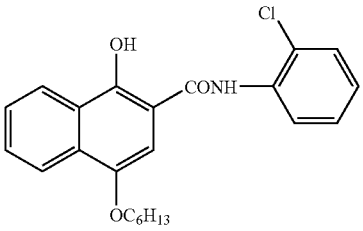

A - 8

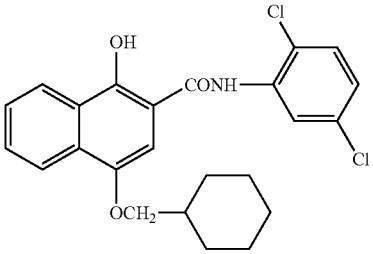

A - 9

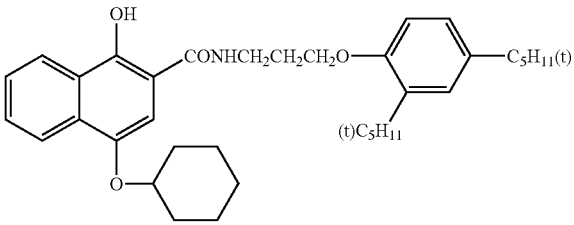

-continued

A - 10

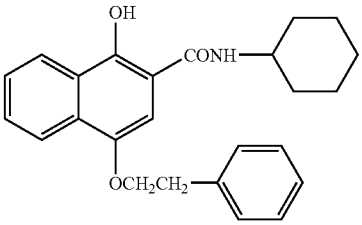

A - 11

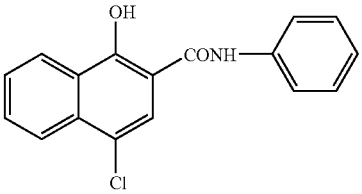

A - 12

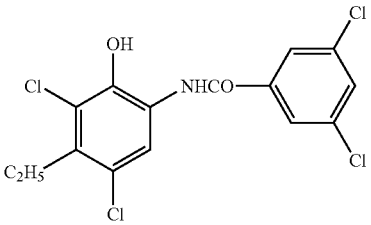

(Hydrogen Bonding Compound)

In the invention, in the case where the reducing agent according to the present invention has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which forms a hydrogen bond with these groups.

As the group forming a hydrogen bond with a hydroxy group or an amino group, there are mentioned a phosphoryl group, a sulfoxide group, a sulfonyl group, a carbonyl group, an amido group, an ester group, a urethane group, a ureido group, a tertiary amino group, a nitrogen-containing aromatic group, and the like. Particularly preferred among them is a phosphoryl group, a sulfoxide group, an amido group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound represented by formula (D) shown below.

Formula (D)

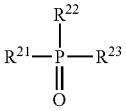

In formula (D), $R^{21}$ to $R^{23}$ each independently represent one selected from an alkyl group, an aryl group, an alkoxy group, an aryloxy group, an amino group, or a heterocyclic group, each of which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As the aryl group, there are mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As the alkoxy group, there are mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As the aryloxy group, there are mentioned a phenoxy group, a cresyloxy group, an isopropylphenoxy group, a 4-t-butylphenoxy group, a naphthoxy group, a biphenyloxy group, and the like.

As the amino group, there are mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others according to the invention are shown below, but the invention is not limited thereto.

D-1

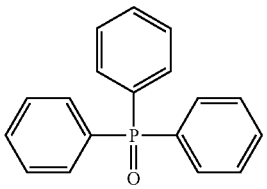

-continued

D-2

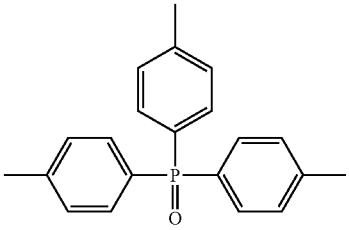

D-3

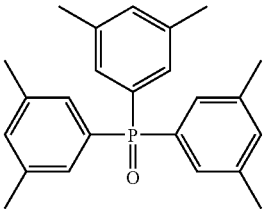

D-4

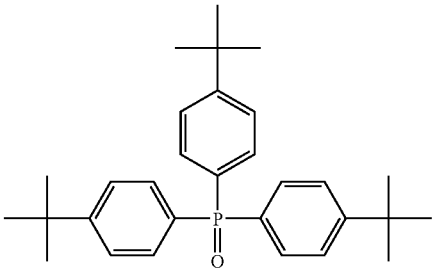

D-5

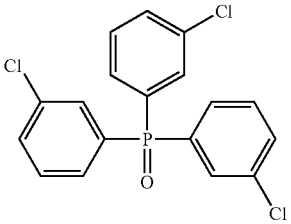

D-6

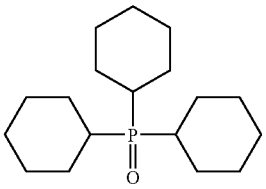

D-7

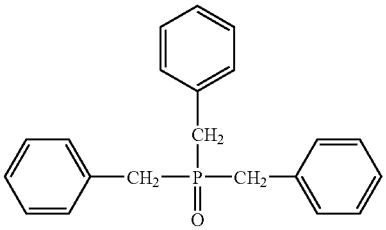

-continued

D-8

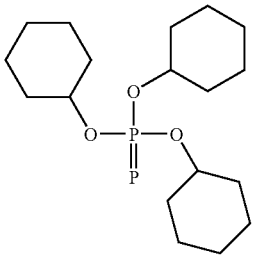

D-9

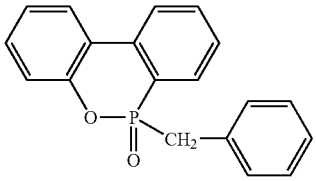

D-10

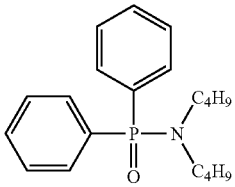

D-11

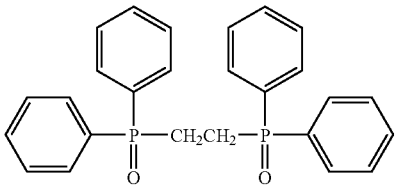

D-12

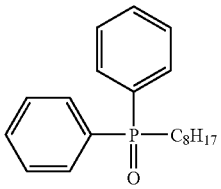

D-13

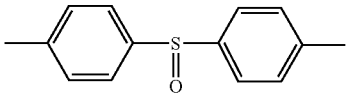

D-14

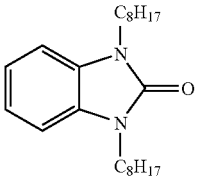

D-15

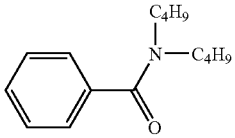

Specific examples of hydrogen bonding compounds other than those enumerated above can be found in those described in EP No. 1,096,310 and JP-A Nos. 2002-156727 and 2002-318431.

The compound represented by formula (D) of the invention can be used in the photothermographic material by being incorporated into the coating solution in the form of a solution, an emulsified dispersion, or a solid fine particle dispersion, similar to the case of reducing agent. However, it is preferably used in the form of a solid dispersion. In the solution, the compound represented by formula (D) forms a hydrogen-bonded complex with a compound having a phenolic hydroxy group or an amino group, and can be isolated as a complex in crystalline state depending on the combination of the reducing agent and the compound represented by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powder and dispersing them with a proper dispersing agent using sand grinder mill or the like.

The compound represented by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition, and silver chloride, silver bromochloride, silver bromide, silver iodobromide, silver iodochlorobromide, or silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 17,029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably in a range of from 0.01 μm to 0.15 μm and, even more preferably from 0.02 μm to 0.12 μm. The grain size as used herein means a diameter of a circle converted such that it has a same area as a projected area of the silver halide grain (projected area of a major plane in a case of a tabular grain).

4) Grain Shape

The shape of the silver halide grain includes, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably 65% or higher and, even more preferably 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used in combination. A preferred content is in a range of from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation; before completion of an emulsion formation step prior to a chemical sensitization step of conducting chalcogen sensitization such as sulfur sensitization, selenium sensitization, or tellurium sensitization, or noble metal sensitization such as gold sensitization; during a washing step; during a dispersion step; and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just prior to completion of grain formation, it can be adsorbed to the outermost surface of the silver halide grain and most of them form an insoluble salt with silver ions on the surface of the grain. Since the hexacyano iron (II) silver salt is a salt less soluble than silver iodide, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various types of gelatins can be used. It is necessary to maintain an excellent dispersion state of a photosensitive silver halide emulsion in the coating solution containing an organic silver salt, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those which spectrally sensitizes the silver halide grains in a desired wavelength region upon adsorption to the silver halide grains having spectral sensitivity suitable to the spectral characteristic of an exposure light source can be advantageously selected. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone or two or more of them may be used in combination. In the invention, sensitizing dye can be added preferably after a desalting step and before coating, and more preferably after a desalting step and before completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No.

587338, U.S. Pat. Nos. 3,877,943 and 4,873,184, JP-A Nos. 5-341432, 11-109547, and 10-111543, and the like.

8) Chemical Sensitization

The photosensitive silver halide grain according to the invention is preferably chemically sensitized by sulfur sensitizing method, selenium sensitizing method, or tellurium sensitizing method. As the compounds used preferably for sulfur sensitizing method, selenium sensitizing method, and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formula (II), (III), or (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred.

As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just prior to coating, or the like.

The amount of sulfur, selenium, or tellurium sensitizer used in the invention may vary depending on the silver halide grain used, the chemical ripening condition, and the like, and it is used in an amount of from $10^{-8}$ mol to $10^{-2}$ mol, and preferably from $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just prior to coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-Electron Oxidation Product which Releases One or More Electrons The photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons, which is contained in the photothermographic material of the invention, is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786,692A1 (Compound INV 1 to 35); EP No. 893,732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). Preferable ranges of these compounds are the same as the preferable ranges described in the quoted specifications.

Formula (1)

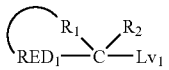

Formula (2)

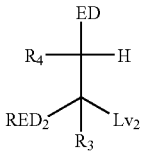

In formulae (1) and (2), $RED_1$ and $RED_2$ each independently represent a reducing group. $R_1$ represents a nonmetallic atomic group forming a cyclic structure equivalent to a tetrahydro derivative or a hexahydro derivative of a 5- or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

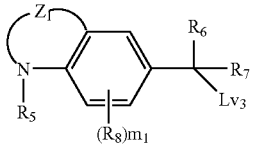

Formula (4)

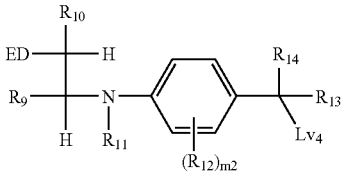

Formula (5)

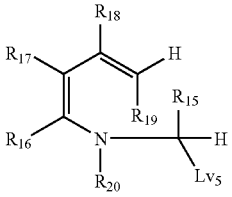

In formulae (3), (4), and (5), $Z_1$ represents an atomic group forming a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent; however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent which substitutes for a hydrogen atom on a benzene ring. $m_1$ represents an integer of from 0 to 3, and m2 represents an integer of from 0 to 4. $Lv_3$, $Lv_4$, and $Lv_5$ each independently represent a leaving group.

Formula (6)

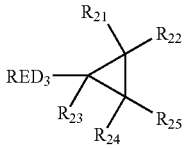

Formula (7)

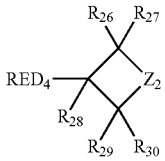

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

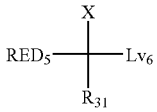

In formula (8), $RED_5$ is a reducing group and represents an arylamino group or a heterocyclic amino group. $R_{31}$, represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

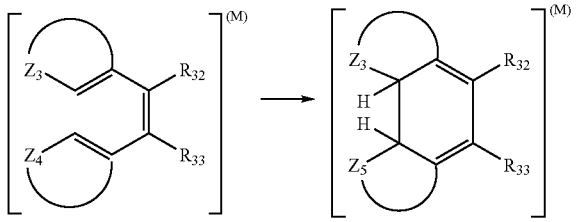

Formula (9)

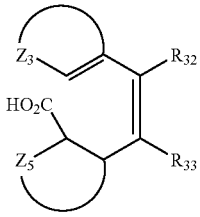

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. M represents one selected from a radical, a radical cation, or a cation. In formula (9), $R_{32}$, $R_{33}$, and $Z_3$ each have the same meaning as in reaction formula (1). $Z_5$ represents a group which forms a 5- or 6-membered cyclic aliphatic hydrocarbon group or heterocyclic group with C—C.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which is one-electron-oxidized. Y represents a reactive group containing a carbon-carbon double bond part, a carbon-carbon triple bond part, an aromatic group part, or benzo-condensed nonaromatic heterocyclic part which reacts with one-electron-oxidized product formed by one-electron-oxidation of $RED_6$ to form a new bond. Q represents a linking group which links $RED_6$ and Y.

Reaction formula (1)

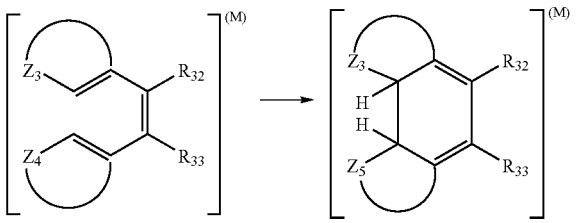

Formula (11)

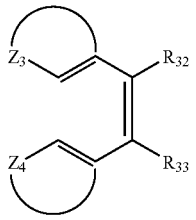

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. $Z_5$ represents a group which forms a 5- or 6-membered cyclic aliphatic hydrocarbon group or heterocyclic group with C—C. M represents one selected from a radical, a radical cation, or a cation. In formula (11), $R_{32}$, $R_{33}$, $Z_3$, and $Z_4$ each have the same meaning as in reaction formula (1).

The compounds of Groups 1 or 2 are preferably "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As the adsorptive group, the group which has two or more mercapto groups as a partial structure in a molecule is also particularly preferable. Herein, the mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as the adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom are described. As typical quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as the adsorptive group is represented by formula (X).

$$(P—Q_1)_i—R(—Q_2—S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with the non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer at the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably contains a compound having an adsorptive group to silver halide and a reducing group in a molecule. It is preferred that the compound is represented by the following formula (1).

$$A\text{-}(W)n\text{-}B \qquad \text{Formula (I)}$$

In formula (1), A represents a group which adsorbs to a silver halide (hereafter, it is called an adsorptive group); W represents a divalent linking group; n represents 0 or 1; and B represents a reducing group.

In formula (1), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion, or the like.

Further, the mercapto group as the adsorptive group may become a thione group by a tautomerization.

The thione group used as the adsorptive group also includes a linear or cyclic thioamido group, thioureido group, thiourethane group, and dithiocarbamate ester group.

The heterocyclic group, as the adsorptive group, which contains at least one atom selected from a nitrogen atom, a sulfur atom, a selenium atom, or a tellurium atom represents a nitrogen-containing heterocyclic group having —NH— group, which forms silver iminate (—N(Ag)—), as a partial structure of a heterocycle, or a heterocyclic group having an —S— group, a —Se— group, a —Te— group, or a ═N— group, which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as the adsorptive group means —C≡CH group and the said hydrogen atom may be substituted.

The adsorptive group described above may have any substituent.

Further, as typical examples of the adsorptive group, the compounds described in pages 4 to 7 in the specification of JP-A No. 11-95355 are described.

As the adsorptive group represented by A in formula (1), a heterocyclic group substituted by a mercapto group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group which forms silver iminate (—N(Ag)—) as a partial structure of heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R^1$ represents a hydrogen atom, an alkyl group, a heterocyclic group, or an aryl group.

The linking group represented by W may have any substituent.

In formula (I), the reducing group represented by B represents a group which reduces a silver ion. As examples thereof, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like are described. They may have any substituent.

The oxidation potential of the reducing group represented by B in formula (I) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When the reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (1), the reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have a ballast group or polymer chain, which are generally used in the non-moving photographic additives of a coupler or the like, in it. And as a polymer, for example, the polymer described in JP-A No. 1-100530 is selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

Specific examples of the compound represented by formula (I) according to the present invention are shown below, but the present invention is not limited in these.

(1)

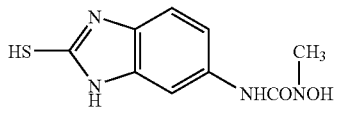

-continued
(2)
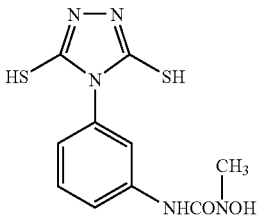
(3)
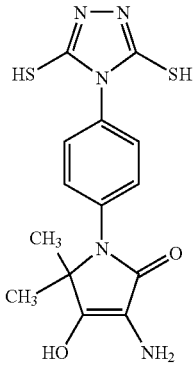
(4)
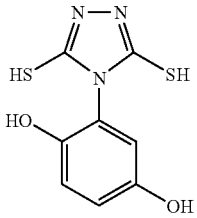
(5)
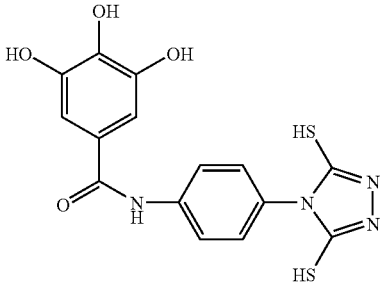
(6)
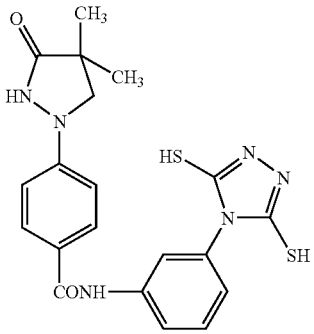
-continued
(7)
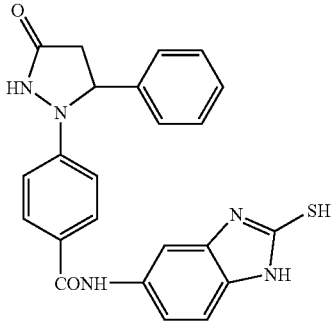
(8)
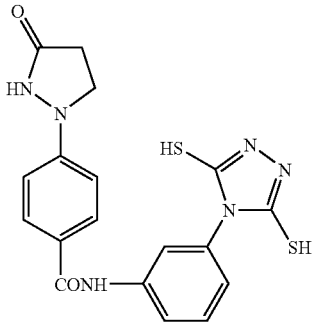
(9)
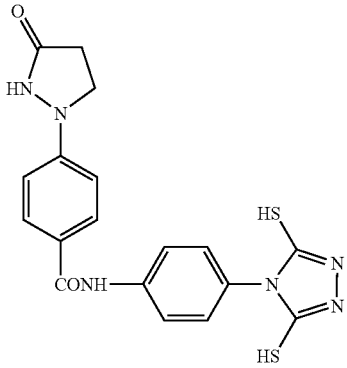
(10)
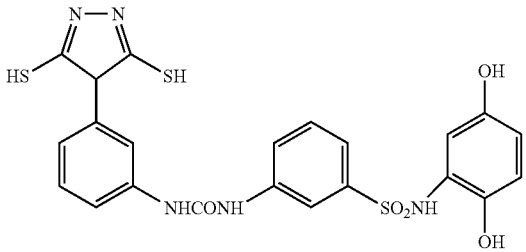
(11)
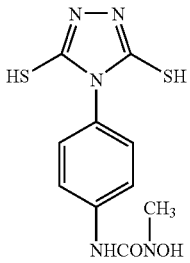

-continued (12)

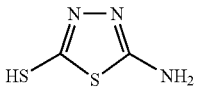

(13)

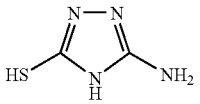

Further, example compounds 1 to 30 and 1"-1 to 1"-77 shown in EP No. 1,308,776A2, pages 73 to 87 are also described as preferable examples of the compound having an adsorptive group and a reducing group according to the invention.

These compounds can be easily synthesized by any known method. The compound of formula (I) according to the present invention may be used alone, but it is preferred to use two or more of the compounds in combination. When two or more of the compounds are used in combination, those may be added to the same layer or the different layers, whereby adding methods may be different from each other.

The compound represented by formula (I) according to the present invention is preferably added to the image forming layer and more preferably, is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer at the coating step.

The preferred addition amount is largely dependent on the adding method described above or the type of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of Silver Halides

The photosensitive silver halide emulsion in the photothermographic material used in the invention may be used alone, or two or more of them (for example, those having different mean grain sizes, different halogen compositions, different crystal habits, or different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably from 0.05 $g/m^2$ to 0.4 $g/m^2$ and, most preferably from 0.07 $g/m^2$ to 0.3 $g/m^2$. The photosensitive silver halide is used in a range of from 0.01 mol to 0.5 mol, preferably from 0.02 mol to 0.3 mol, and even more preferably from 0.03 mol to 0.2 mol, per 1 mol of the organic silver salt.

13) Mixing Silver Halide and Organic Silver Salt

Concerning the mixing method and the condition of mixing separately prepared the photosensitive silver halide and the organic silver salt, there are mentioned a method of mixing prepared photosensitive silver halide grains and organic silver salt by a high speed stirrer, ball mill, sand mill, colloid mill, vibration mill, or homogenizer, and a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling photographic properties.

14) Mixing Silver Halide into Coating Solution

In the invention, the time of adding silver halide to the coating solution for the image forming layer is preferably in a range of from 180 minutes before to just prior to the coating, and more preferably 60 minutes before to 10 seconds before coating. But there is no restriction for mixing method and mixing condition as far as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Binder for Image Forming Layer)

Any polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly (vinyl acetals) (e.g., poly(vinyl formal) or poly(vinyl butyral)), polyesters, polyurethanes, phenoxy resin, poly (vinylidene chlorides), polyepoxides, polycarbonates, poly (vinyl acetates), polyolefins, cellulose esters, and polyamides. The binder may be used with water, an organic solvent, or emulsion to form a coating solution.

In the present invention, the glass transition temperature (Tg) of the binder which is used in the image forming layer is preferably in a range of from 0° C. to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer components (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20° C. or higher and the polymer having Tg of lower than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As the water-miscible organic solvent, there are described, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, and the like.

The term "aqueous solvent" is also used in the case where the polymer is not thermodynamically dissolved, but is present in a so-called dispersed state.

The term "equilibrium water content at 25° C. and 60% RH" referred herein can be expressed as follows:

$$\text{Equilibrium water content at 25° C. and 60\% RH} = [(W1-W0)/W0]\times 100 \text{ (\% by weight)}$$

wherein W1 is the mass of the polymer in moisture-controlled equilibrium under an atmosphere of 25° C. and 60% RH, and W0 is the absolutely dried mass at 25° C. of the polymer. For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, more preferably in a range of from 0.01% by weight to 1.5% by weight, and even more preferably from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. A mean particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution. From the viewpoint of controlling the physical properties of the coating solution, preferred mode of usage includes mixing two or more types of dispersed particles each having monodispersed particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Example of Latex>

Specific examples of preferred polymer latex are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1: Latex of -MMA(70)-EA(27)-MAA(3)-(molecular weight 37000, Tg 61° C.)

P-2: Latex of -MMA(70)-2EHA(20)-St(5)-AA(5)-(molecular weight 40000, Tg 59° C.)

P-3: Latex of -St(50)-Bu(47)-MAA(3)-(crosslinking, Tg −17° C.)

P-4: Latex of -St(68)-Bu(29)-AA(3)-(crosslinking, Tg 17° C.)

P-5: Latex of -St(71)-Bu(26)-AA(3)-(crosslinking, Tg 24° C.)

P-6: Latex of -St(70)-Bu(27)-IA(3)-(crosslinking)

P-7: Latex of -St(75)-Bu(24)-AA(1)-(crosslinking, Tg 29° C.)

P-8: Latex of -St(60)-Bu(35)-DVB(3)-MAA(2)-(crosslinking)

P-9: Latex of -St(70)-Bu(25)-DVB(2)-AA(3)-(crosslinking)

P-10: Latex of -VC(50)-MMA(20)-EA(20)-AN(5)-AA(5)-(molecular weight 80000)

P-11: Latex of -VDC(85)-MMA(5)-EA(5)-MAA(5)-(molecular weight 67000)

P-12: Latex of -Et(90)-MAA(10)-(molecular weight 12000)

P-13: Latex of -St(70)-2EHA(27)-AA(3)-(molecular weight 130000, Tg 43° C.)

P-14: Latex of -MMA(63)-EA(35)-AA(2)-(molecular weight 33000, Tg 47° C.)

P-15: Latex of -St(70.5)-Bu(26.5)-AA(3)-(crosslinking, Tg 23° C.)

P-16: Latex of -St(69.5)-Bu(27.5)-AA(3)-(crosslinking, Tg 20.5° C.)

P-17: Latex of -St(61.3)-Isoprene(35.5)-AA(3)-(crosslinking, Tg 17° C.)

P-18: Latex of -St(67)-Isoprene(28)-Bu(2)-AA(3)-(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable Latex>

Particularly preferable as the polymer latex for use in the invention is that of styrene-butadiene copolymer or that of styrene-isoprene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of monomer content is similar to that described above. Further, the ratio of copolymerization and the like in the styrene-isoprene copolymer are similar to those in the styrene-butadiene copolymer.

As the latex of styrene-butadiene copolymer preferably used in the invention, there are mentioned P-3 to P-9 and P-15 described above, and commercially available LACSTAR-3307B, 7132C, Nipol Lx416, and the like. And as examples of the latex of styrene-isoprene copolymer, there are mentioned P-17 and P-18 described above.

In the image forming layer of the photothermographic material according to the invention, if necessary, there may be added hydrophilic polymers such as gelatin, poly(vinyl alcohol), methyl cellulose, hydroxypropyl cellulose, carboxymethyl cellulose, or the like. The hydrophilic polymer is preferably added in an amount of 30% by weight or less, and more preferably 20% by weight or less, with respect to the total weight of the binder incorporated in the image forming layer.

According to the invention, the layer containing organic silver salt (image forming layer) is preferably formed by using polymer latex for the binder. Concerning the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The layer containing organic silver salt is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide, and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there are mentioned those disclosed as patents in paragraph number 0070 of JP-A No. 10-62899 and in line 57 of page 20 to line 7 of page 21 of EP-A No.

803,764A1, the compounds described in JP-A Nos. 9-281637 and 9-329864, U.S. Pat. No. 6,083,681, and EP-A No. 1,048,975.

1) Organic Polyhalogen Compound

Preferable organic polyhalogen compound that can be used in the invention is explained specifically below. In the invention, preferred organic polyhalogen compound is the compound represented by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include a halogen atom, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group, and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinio group, or the like), a polyethyleneoxy group, a hydroxy group, or the like is also preferable.

Specific examples of the compound represented by formula (H) of the invention are shown below.

H-1

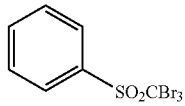

H-2

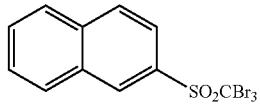

H-3

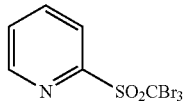

H-4

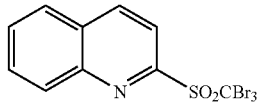

H-5

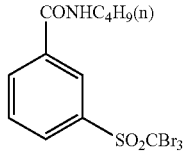

H-6

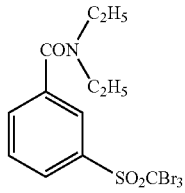

H7

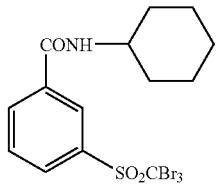

H-8

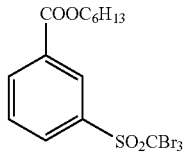

H-9

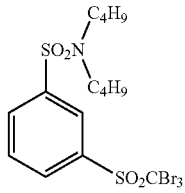

-continued

H-10

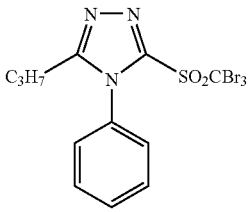

H-11

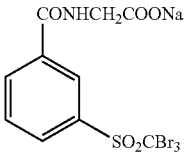

H-12

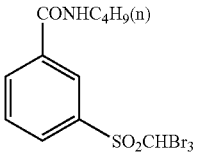

H-13

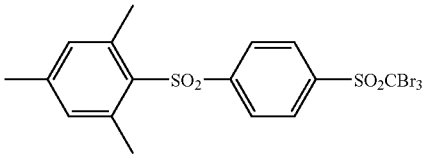

H-14

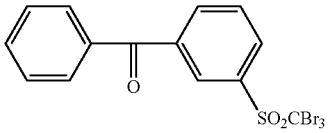

H-15

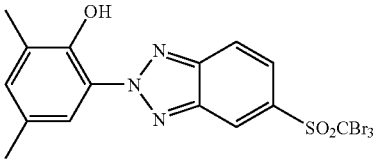

H-16

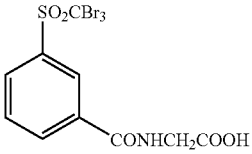

H-17

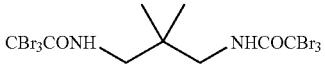

H-18

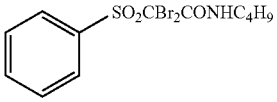

H-19

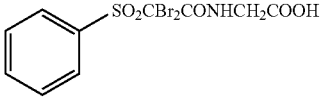

As preferred organic polyhalogen compounds which can be used in the present invention other than those described above, there are mentioned compounds disclosed in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 2001-312027 are preferable.

The compound represented by formula (H) of the invention is preferably used in an amount of from $10^{-4}$ mol to 1 mol, more preferably from $10^{-3}$ mol to 0.5 mol and, even more preferably from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there are mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to Claim 9 of JP-A No. 11-352624, a compound represented by formula (III), 4-hydroxy-6-methyl-1,3,3a,7-tetraazaindene and the like, described in JP-A No. 6-11791.

The photothermographic material according to the invention may further contain an azolium salt in order to prevent fogging. Azolium salts useful in the present invention include a compound represented by formula (XI) described in JP-A No. 59-193447, a compound described in Japanese Patent Application Publication (JP-B) No. 55-12581, and a compound represented by formula (II) in JP-A No. 60-153039. The azolium salt may be added to any part of the photothermographic material, but as the layer to be added, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the azolium salt after preparing the organic silver salt and just before coating. As the method for adding the azolium salt, any method using powder, a solution, a fine particle dispersion, or the like may be used. Furthermore, it may be added as a solution having mixed therein other additives such as sensitizing agents, reducing agents, toners, and the like. In the invention, the azolium salt may be added in any amount, but preferably, it is added in a range of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storability before development and storability after development. Descriptions can be found in paragraph numbers 0067 to 0069 of JP-A No. 10-62899, a compound represented by formula (I) of JP-A No. 10-186572 and specific examples thereof shown in paragraph numbers 0033 to 0052, in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, addition of a toner is preferred. Description on the toner can be found in JP-A No. 10-62899 (paragraph numbers 0054 to 0055), EP No. 803,764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point and an ester of a fatty acid having a branch structure and a molecular weight of 1000 or more.

Concerning plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

4) Dyes and Pigments

From the viewpoints of improving color tone, preventing the generation of interference fringes, and preventing irradiation on laser exposure, various dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator in the image forming layer. Details on the nucleators, method for their addition, and addition amount can be found in paragraph No. 0118 of JP-A No. 11-65021, paragraph Nos. 0136 to 0193 of JP-A No. 11-223898, as compounds represented by formulae (H), (1) to (3), (A), or (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphosphorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The photothermographic material according to the invention includes, on at least one side of a support, an image forming layer, a non-photosensitive intermediate layer, and a non-photosensitive layer, which are disposed in this order from the support side. The image forming layer contains the first non-photosensitive organic silver salt, and the non-photosensitive layer contains the second non-photosensitive organic silver salt.

Preferably, the photothermographic material according to the invention further includes a non-photosensitive outermost layer on the side having thereon the image forming layer. Hereinafter, to make it easy to understand the following description, the non-photosensitive intermediate layer is sometimes expressed as "intermediate layer B" and the non-photosensitive layer containing the second non-photosensitive organic silver salt is sometimes expressed as "intermediate layer A".

In addition to these, the photothermographic material of the present invention may have an undercoat layer disposed on the support and a back layer on the opposite side of the support from the image forming layer.

Further, in the case where a layer which functions as an optical filter is disposed, a light absorbing agent (dye, pigment, or the like) is incorporated in any non-photosensitive layer on the same side of the image forming layer as the exposure side. In the case where a layer which functions as an antihalation layer is disposed, a light absorbing agent (dye, pigment, or the like) is incorporated in any non-photosensitive layer on the opposite side of the image forming layer form the exposure side.

1) Binder for Intermediate Layer A and Intermediate Layer B

In the present invention, it is preferred that 50% by weight or more of the binder for the intermediate layer B is a polymer latex. As other component of the binder, it is preferred to use hydrophilic polymer described below. The binder for the intermediate layer A is preferably a hydrophilic binder. The intermediate layers A and B may contain various additives such as a development accelerator, an antifoggant, a dye, a pigment, a plasticizer, a lubricant, a crosslinking agent, a surfactant, or the like.

Preferred polymer latex is a polymer latex which contains a monomer component represented by formula (M) within a range of from 10% by weight to 70% by weight.

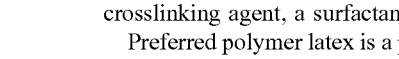

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group. More preferably, both of $R^{01}$ and $R^{02}$ represent a hydrogen atom, or one of $R^{01}$ or $R^{02}$ represents a hydrogen atom and the other represents a methyl group.

As the alkyl group for $R^{01}$ or $R^{02}$, an alkyl group having 1 to 4 carbon atoms is preferred, and more preferred is an alkyl group having 1 or 2 carbon atoms. As the halogen atom for $R^{01}$ or $R^{02}$, a fluorine atom, a chlorine atom, or a bromine atom is preferred, and more preferred is a chlorine atom.

Preferably, both of $R^{01}$ and $R^{02}$ represent a hydrogen atom, or one of $R^{01}$ and $R^{02}$ represents a hydrogen atom and the other represents a methyl group or a chlorine atom, and more preferably, both of $R^{01}$ and $R^{02}$ represent a hydrogen atom, or one of $R^{01}$ and $R^{02}$ represents a hydrogen atom and the other represents a methyl group.

Specific examples of the monomer represented by formula (M) according to the present invention include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

The copolymerization ratio of the monomer represented by formula (M) according to the present invention is in a range of from 10% by weight to 70% by weight, preferably from 15% by weight to 65% by weight, and more preferably from 20% by weight to 60% by weight. When the copolymerization ratio of the monomer represented by formula (M) is less than 10% by weight, the bonding component of the binder is decreased and manufacturing-related brittleness is deteriorated.

When the copolymerization ratio of the monomer represented by formula (M) exceeds 70% by weight, the bonding component of the binder is increased, mobility of the binder is increased, and as a result, image storability is deteriorated.

In addition to the above components, the polymer of the present invention is preferably copolymerized with a monomer having an acid group. As the acid group, preferred are a carboxy group, a sulfonyl group, and a phosphate group; and particularly preferred is a carboxy group. The copolymerization ratio of the monomer having an acid group is preferably from 1% by weight to 20% by weight, and more preferably from 1% by weight to 10% by weight. Specific examples of the monomer having an acid group include acrylic acid, methacrylic acid, itaconic acid, p-styrenesulfonic acid, isoprenesulfonic acid, salts thereof, phosphoryl ethyl methacrylate, and the like. Preferred are acrylic acid, methacrylic acid, and salts thereof; and particularly preferred are acrylic acid and a salt thereof.

The binder of the present invention preferably has a grass transition temperature (Tg) in a range of from −30° C. to 70° C., more preferably in a range of from −10° C. to 50° C., and even more preferably in a range of from 0° C. to 40° C., considering film-forming property and image storability. Two or more types of polymers can be blended for the binder, and in this case, the blended polymer has a weighed averaged Tg which preferably falls within the range above, considering composition components. When the polymers exhibit phase separation or has a core-shell structure, a weighed averaged Tg preferably falls within the range above.

The polymer used for the binder of the invention can be readily obtained by a solution polymerizing method, a suspension polymerizing method, an emulsion polymerizing method, a dispersion polymerizing method, an anionic polymerizing method, a cationic polymerizing method, or the like, however most preferable is an emulsion polymerizing method by which polymer can be obtained as a latex. For example, the polymer latex is obtained by emulsion polymerization at about 30° C. to 100° C., preferably at 60° C. to 90° C., for 3 hours to 24 hours with stirring using water or a mixed solvent of water and a water-miscible organic solvent (for example, methanol, ethanol, acetone, or the like) as a dispersion medium, and using a monomer mixture in an amount of 5% by weight to 150% by weight with respect to the dispersion solvent, an emulsifying agent in an amount of 0.1% by weight to 20% by weight with respect to a total amount of monomers, and a polymerization initiator. Conditions such as the dispersion medium, the monomer concentration, the amount of the initiator, the amount of the emulsifying agent, the amount of the dispersing agent, the reaction temperature, and the adding method of the monomer are appropriately determined considering the type of the monomer used. It is preferred to use a dispersing agent, if necessary.

Emulsion polymerization is usually carried out according to the following documents: "Gosei Jushi Emulsion (Synthetic Resin Emulsion)" ed. by Taira Okuda and Hiroshi Inagaki, Polymer Publishing Association (1978); "Gosei Latex no Oyo (Application of Synthetic Latex)" ed. by Taka-aki Sugimura, Yasuo Kataoka, Soichi Suzuki and Keiji Kasahara, Polymer Publishing Association (1993); and "Gosei Latex no Kagaku (Chemistry of Synthetic Latex)" by Soichi Muroi, Polymer Publishing Association (1970).

Emulsion polymerizing method for synthesizing the polymer latex of the invention can be selected from an overall polymerizing method, a monomer adding (continuous or divided) method, an emulsion adding method and a seed polymerizing method. The overall polymerizing method, the monomer adding (continuous or divided) method, and the emulsion adding method are preferable in view of productivity of the latex.

It is enough that the polymerization initiator has radical generation ability. Examples of them available include inorganic peroxides such as persulfate salts and hydrogen peroxide, peroxides described in the catalogue of organic peroxides by Nippon Oil and Fat Co., and azo compounds described in azo polymerization initiator catalogue by Wako Pure Chemical Industries, Ltd. Among them, water-soluble peroxides such as persulfate, and water-soluble azo compounds described in azo polymerization initiator catalogue by Wako Pure Chemical Industries, Ltd., are preferable. Ammonium persulfate, sodium persulfate, potassium persulfate, azobis(2-methylpropionamidine)hydrochloride, azobis(2-methyl-N-(2-hydroxyethyl)propionamide), and azobiscyanovaleric acid are more preferable, and particularly, peroxides such as ammonium persulfate, sodium persulfate, and potassium persulfate are preferable from the viewpoints of image storability, solubility, and cost.

The addition amount of the polymerization initiator is preferably in a range of from 0.3% by weight to 2.0% by weight, more preferably from 0.4% by weight to 1.75% by weight, and particularly preferably from 0.5% by weight to 1.5% by weight, with respect to the total amount of monomers. Image storability decreases when the amount of the polymerization initiator is less than 0.3% by weight, while the latex tends to be aggregated to deteriorate coating ability when the amount of the polymerization initiator exceeds 2.0% by weight.

Concerning the polymerization emulsifying agent, any surfactants such as an anionic surfactant, a nonionic surfactant, a cationic surfactant, or an amphoteric surfactant can be employed. An anionic surfactant is preferably employed from the viewpoints of dispersibility and image storability, and more preferred is a sulfonic acid-type anionic surfactant which maintains the polymerization stability even in a small amount and has a hydrolysis resistance. Even more preferred is a long chained alkyl diphenylether disulfonate such as "PELEX SS—H" (trade name, available from Kao Co., Ltd.), and particularly preferred is a low electrolyte-type surfactant such as "PIONIN A-43-S" (trade name, available from Takemoto Oil & Fat Co., Ltd.).

As the polymerization emulsifying agent, a sulfonic acid-type surfactant is preferably used in a range of from 0.1% by weight to 10.0% by weight, more preferably from 0.2% by weight to 7.5% by weight, and particularly preferably from 0.3% by weight to 5.0% by weight, with respect to the total amount of monomers in each case. Stability in the emulsion polymerization process can not secure when the addition amount of the polymerization emulsifying agent is less than 0.1% by weight, while image storability decreases when the addition amount exceeds 10.0% by weight.

It is preferred to use a chelating agent for the synthesis of the polymer latex used in the invention. The chelating agent is a compound which coordinates multi-valent metal ions such as iron ion, and alkali earth metal ions such as calcium ion; and examples thereof include compounds described in JP-B No. 6-8956; U.S. Pat. No. 5,053,322; and JP-A Nos. 4-73645, 4-127145, 4-247073, 4-305572, 6-11805, 5-173312, 5-66527, 5-158195, 6-118580, 6-110168, 6-161054, 6-175299, 6-214352, 7-114161, 7-114154, 7-120894, 7-199433, 7-306504, 9-43792, 8-314090, 10-182571, 10-182570, and 11-190892.

The chelating agent is preferably an inorganic chelating compound (sodium tripolyphosphate, sodium hexametaphosphate, sodium tetrapolyphosphate, or the like), an aminopolycarboxylic acid chelating compound (nitrilotriacetic acid, ethylenediamine tetraacetic acid, or the like), an organic phosphonic acid chelating agent (compounds described in Research Disclosure No. 18170, JP-A Nos. 52-102726; 53-42730, 56-97347, 54-121127, 55-4024, 55-4025, 55-29883, 55-126241, 55-65955, 55-65956, 57-179843, and 54-61125; and West Germany Patent (WGP) No. 1,045,373), a polyphenol chelating agent, or a polyamine chelating agent. An aminopolycarboxylic acid derivative is particularly preferable.

Preferable examples of the aminopolycarboxylic acid derivative are compounds described in the supplement table of "EDTA (—Chemistry of Complexane—)", Nankodo 1977. A part of the carboxy group of these compounds may be substituted by a salt of alkali metal such as sodium or potassium, or an ammonium salt. Particularly preferable aminocarboxylic acid derivatives include iminodiacetic acid, N-methyliminodiacetic acid, N-(2-aminoethyl)iminodiacetic acid, N-(carbamoylethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. A part of the carboxy group of these compounds may be substituted by a salt of alkali metal such as sodium or potassium, or an ammonium salt.

The addition amount of the chelating agent is preferably from 0.01% by weight to 0.4% by weight, more preferably from 0.02% by weight to 0.3% by weight, and particularly preferably from 0.03% by weight to 0.15% by weight, with respect to the total amount of monomers. Metal ions mingling in the production process of the polymer latex are insufficiently trapped when the amount of the chelating agent is less than 0.01% by weight to decrease stability of the latex against aggregation to deteriorate coating ability. When the content exceeds 0.4% by weight, on the other hand, viscosity of the latex increases to deteriorate coating ability.

A chain transfer agent is preferably used in the synthesis of the polymer latex used in the present invention. Gelation ratio can be controlled by the addition of a chain transfer agent. The compounds described in Polymer Handbook Third Edition (Wiley-Interscience, 1989) are preferable as the chain transfer agents. Sulfur compounds are preferable since they have high chain transfer ability to make the amount of use of the reagent small. Particularly preferable chain transfer agents are hydrophobic mercaptan chain transfer agents such as tert-dodecylmercaptan, n-dodecylmercaptan, or the like.

The amount of the chain transfer agent is preferably from 0.2% by weight to 2.0% by weight, more preferably from 0.3% by weight to 1.8% by weight, and particularly preferably from 0.4% by weight to 1.6% by weight, with respect to the total amount of monomers.

In the emulsion polymerization, additives such as an electrolyte, a stabilizer, a thickener, a defoaming agent, an antioxidant, a vulcanizing agent, an antifreeze agent, a gelling agent, a vulcanization accelerator, or the like described in Synthetic Rubber Handbook and the like may be used in addition to the compounds above.

<Specific Examples of Polymer>

Specific examples of the polymer used in the present invention are listed below, however the invention is not restricted to these. x, y, z, and z' in chemical formula show the mass ratios in the polymer composition, and the sum of x, y, z, and z' is equal to 100%. Tg represents the glass transition temperature of a dry film obtained from the polymer.

P-1

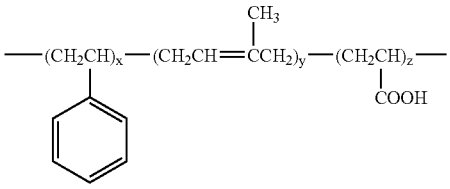

Tg = 17° C. x = 61.5 y = 35.5 z = 3

P-2

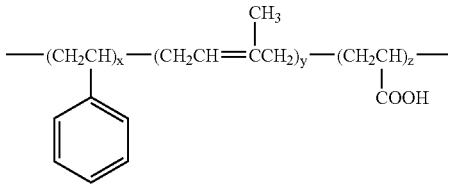

Tg = 20° C. x = 63 y = 34 z = 3

P-3

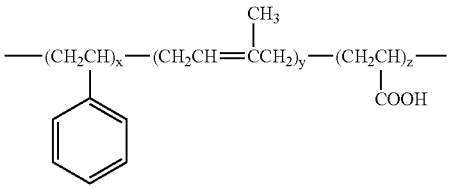

Tg = 24° C. x = 65 y = 32 z = 3

P-4

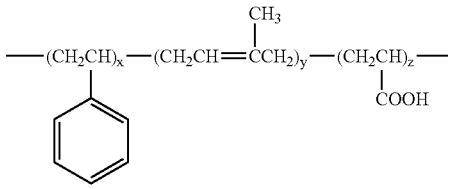

Tg = 13° C. x = 59.5 y = 37.5 z = 3

P-5

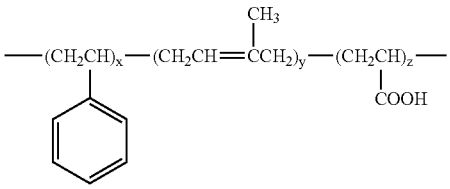

Tg = -7° C. x = 45 y = 50 z = 5

P-6

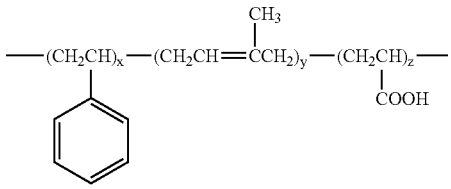

Tg = 60° C. x = 79 y = 15 z = 6

P-7

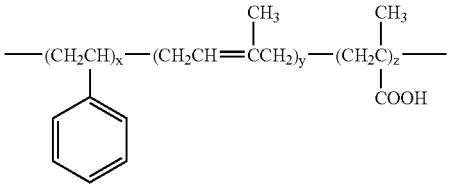

Tg = 8° C. x = 55 y = 41 z = 4

P-8

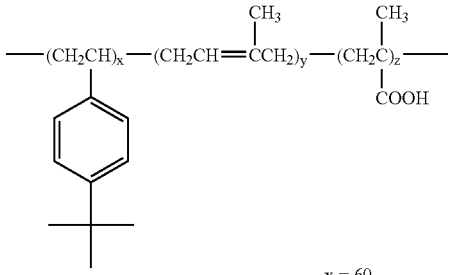

Tg = 32° C. x = 60 y = 35 z = 5

P-9

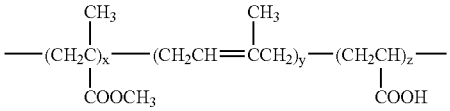

Tg = 24° C. x = 62 y = 33 z = 5

P-10

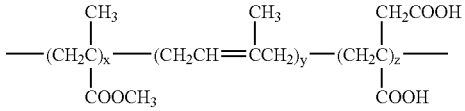

Tg = 28° C. x = 63 y = 33 z = 4

-continued
P-11
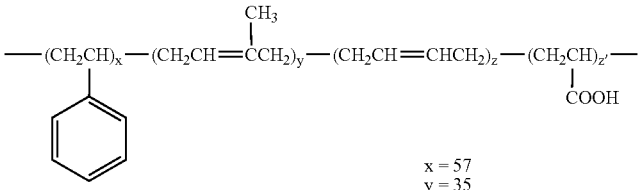
Tg = 8° C. x = 57, y = 35, z = 5, z′ = 3
P-12
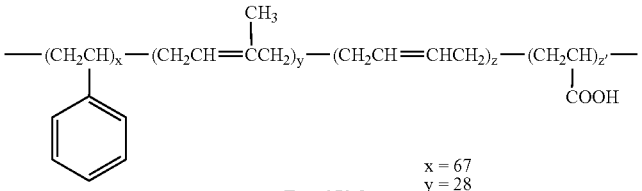
Tg = 27° C. x = 67, y = 28, z = 2, z′ = 3
P-13
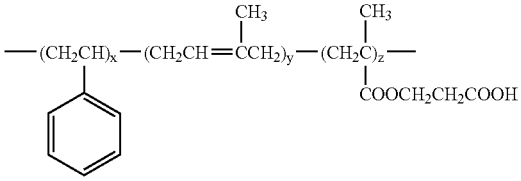
Tg = 32° C. x = 70, y = 20, z = 15
P-14
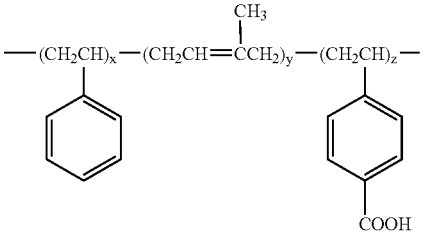
Tg = 50° C. x = 65, y = 20, z = 15
P-15
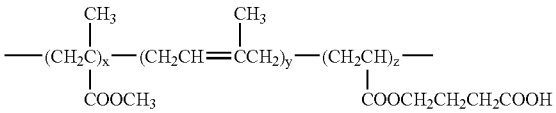
Tg = 3° C. x = 50, y = 38, z = 12
P-16
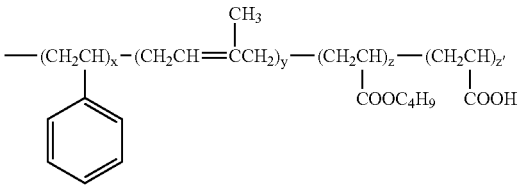
Tg = 24° C. x = 60, y = 10, z = 25, z′ = 5
P-17
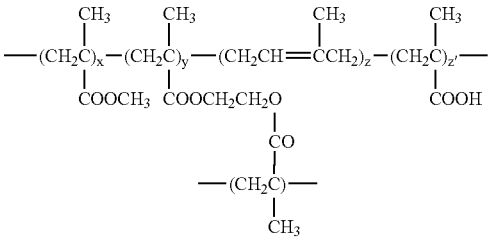
Tg = 66° C. x = 79, y = 2, z = 15, z′ = 4

-continued
P-18
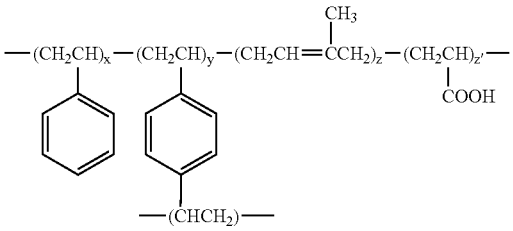
Tg = 35° C. x = 66, y = 2, z = 29, z′ = 3
P-19
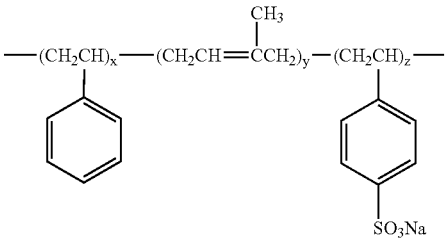
Tg = 18° C. x = 63, y = 35, z = 2
P-20
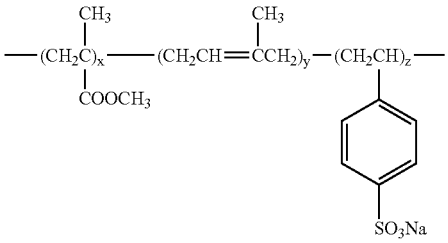
Tg = 3° C. x = 51, y = 45, z = 4
P-21
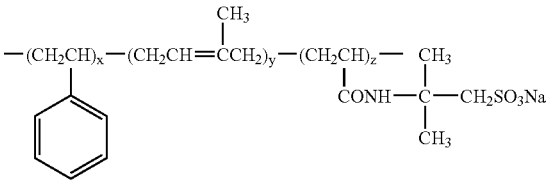
Tg = -30° C. x = 29, y = 70, z = 1
P-22
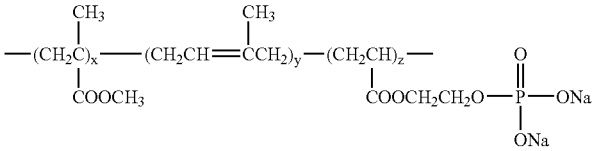
Tg = -12° C. x = 43, y = 54, z = 3
P-23
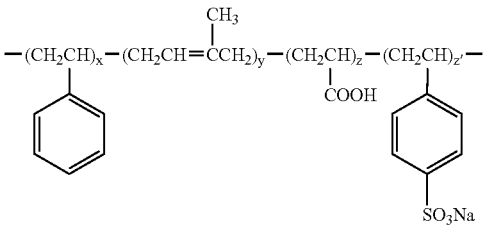
Tg = 28° C. x = 67, y = 30, z = 1, z′ = 2
P-24
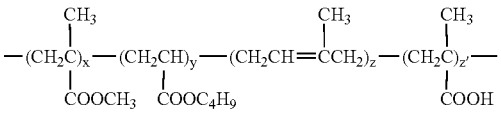
Tg = 42° C. x = 70, y = 22, z = 5, z′ = 3
P-25
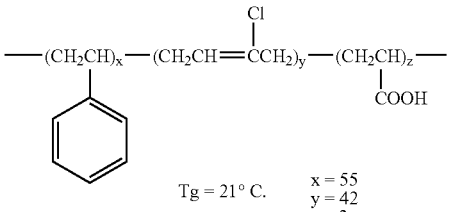
Tg = 21° C. x = 55, y = 42, z = 3
P-26
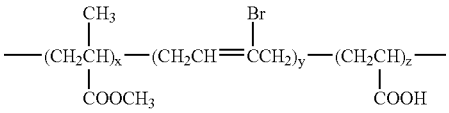
Tg = -10° C. x = 49, y = 58, z = 3

-continued
P-27
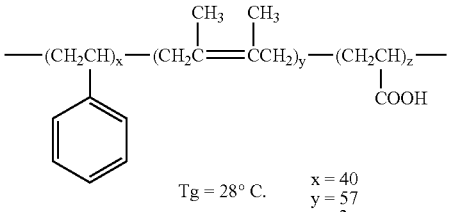
Tg = 28° C. x = 40 y = 57 z = 3
P-28
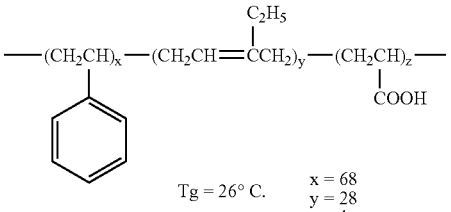
Tg = 26° C. x = 68 y = 28 z = 4
P-29
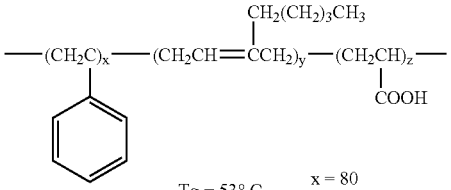
Tg = 53° C. x = 80 y = 15 z = 5
P-31
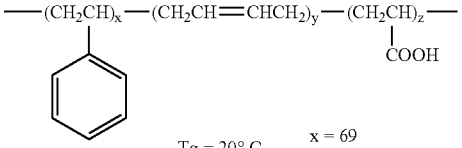
Tg = 20° C. x = 69 y = 28 z = 3
P-32
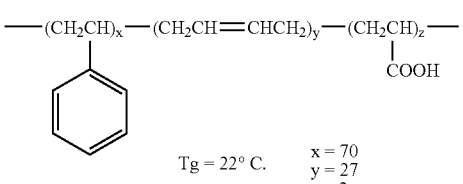
Tg = 22° C. x = 70 y = 27 z = 3
P-33
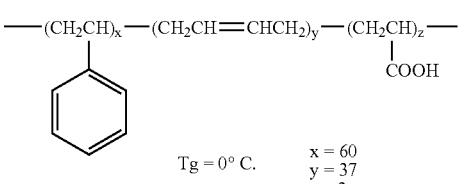
Tg = 0° C. x = 60 y = 37 z = 3
P-34
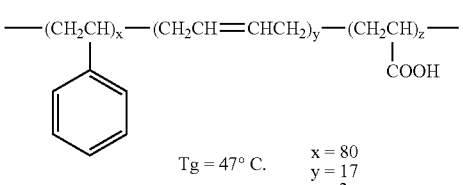
Tg = 47° C. x = 80 y = 17 z = 3
P-35
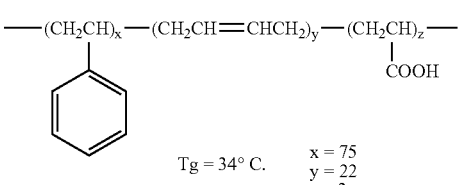
Tg = 34° C. x = 75 y = 22 z = 3
P-36
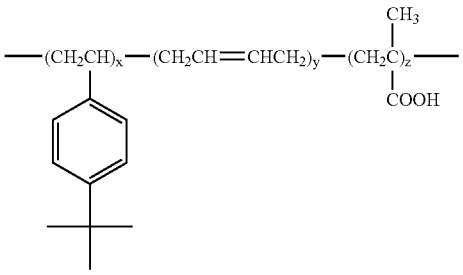
Tg = 9° C. x = 60 y = 37 z = 3
P-37
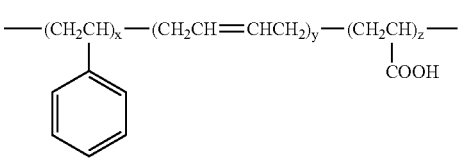
Tg = 5° C. x = 62 y = 35 z = 3
P-38
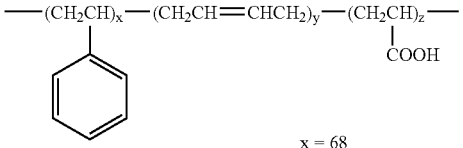
Tg = 17° C. x = 68 y = 29 z = 3
P-39
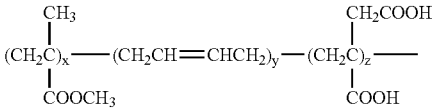
Tg = 8° C. x = 62 y = 34 z = 4

-continued
P-40
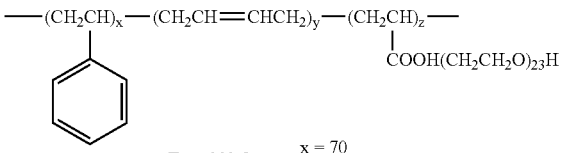
Tg = 22° C. x = 70 y = 15 z = 15
P-41
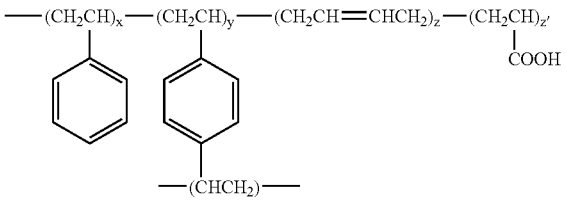
Tg = 15° C. x = 65 y = 2 z = 30 z′ = 3
P-42
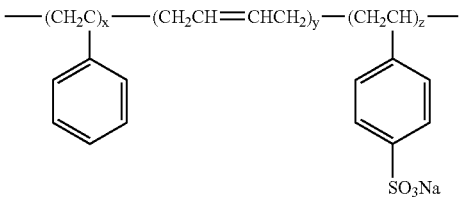
Tg = 19° C. x = 70 y = 27 z = 3
P-43
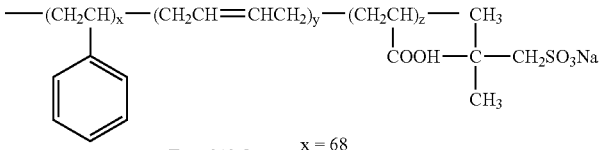
Tg = 21° C. x = 68 y = 29 z = 3
P-44
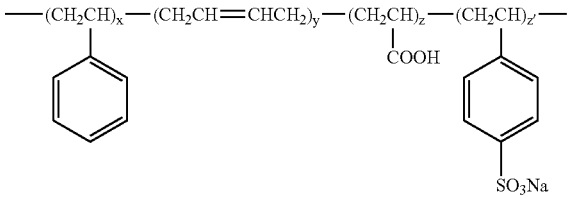
Tg = 24° C. x = 70 y = 27 z = 1 z′ = 2
P-45
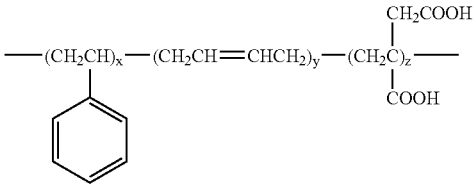
Tg = 23° C. x = 70 y = 27 z = 3

-continued

P-46

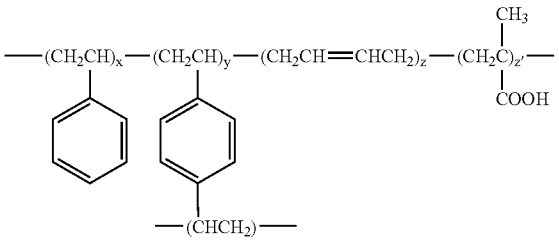

Tg = 6° C. x = 60 y = 3 z = 35 z' =2

As examples of commercially available latex of styrene-butadiene copolymer preferably used in the present invention, there are mentioned LACSTAR-3307B and 7132C (all manufactured by Dainippon Ink and Chemicals, Inc.), Nipol Lx416 (manufactured by Nippon Zeon Co., Ltd.), and the like.

The polymer latex above may be used alone, or may be used by blending two or more of them, depending on needs.

In the invention, for the solvent of a coating solution for the polymer latex, water solvent can be used and any of water-miscible organic solvents may be used in combination. As a water-miscible organic solvent, there can be described, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, and the like. The addition amount of the organic solvent is preferably 50% by weight or less, and more preferably 30% by weight or less, with respect to the solvent.

As for the polymer latex of the invention, the concentration of the polymer is preferably from 10% by weight to 70% by weight, more preferably from 20% by weight to 60% by weight, and particularly preferably from 30% by weight to 55% by weight, with respect to the latex liquid in each case.

The equilibrium water content at 25° C. and 60% RH is preferably 2% by weight or lower, but is more preferably in a range of from 0.01% by weight to 1.5% by weight, and even more preferably from 0.02% by weight to 1.0% by weight.

A mean particle diameter of the latex particles according to the invention is in a range of from 1 nm to 50,000 nm, preferably from 5 nm to 1,000 nm, more preferably from 10 nm to 500 nm, and even more preferably from 50 nm to 200 nm. There is no particular limitation concerning a particle diameter distribution, and they may be widely distributed or may exhibit a monodispersed particle diameter distribution. From the viewpoint of controlling the physical properties of the coating solution, preferred mode of usage includes mixing two or more types of dispersed particles each having a monodispersed particle diameter distribution.

In the non-photosensitive intermediate layer B of the present invention, if necessary, there may be added hydrophilic polymers such as gelatin, poly(vinyl alcohol), methyl cellulose, hydroxypropyl cellulose, carboxymethyl cellulose, or the like. The hydrophilic polymers above are preferably added in an amount of 50% by weight or less, and more preferably 20% by weight or less, with respect to a total weight of the binder incorporated in the non-photosensitive intermediate layer B.

The total amount of coated binder in the non-photosensitive intermediate layer A according to the invention is preferably in a range of from 0.5 g/m$^2$ to 3.0 g/m$^2$, and more preferably from 1.0 g/m$^2$ to 2.0 g/m$^2$.

The total amount of coated binder in the non-photosensitive intermediate layer B according to the invention is preferably in a range of from 0.3 g/m$^2$ to 3.0 g/m$^2$, and more preferably from 0.5 g/m$^2$ to 1.5 g/m$^2$.

2) Outermost Layer

It is preferred that an outermost layer is disposed on the side having thereon the image forming layer according to the present invention.

Because the outermost layer forms an outermost surface on the image forming layer side of a photothermographic material, the task of the outermost layer is usually to prevent adhesion with other surfaces or parts and to prevent defects on an image so as to improve transportability and to protect the surfaces of the photothermographic materials. Thereby, besides the binder, the outermost layer preferably contains various additives such as a matting agent, a lubricant, a surfactant, or the like.

The outermost layer according to the invention preferably contains hydrophilic polymer in an amount of 50% by weight or more, and more preferably 60% by weight or more, as binder.

In the present invention, the hydrophilic polymer is preferably a hydrophilic polymer derived from animal protein. The hydrophilic polymer derived from animal protein means natural or chemically modified water-soluble polymer such as glue, casein, gelatin, egg white, or the like. It is preferably gelatin, which includes acid-processed gelatin and alkali-processed gelatin (lime-processed gelatin or the like) depending on a synthetic method, and any of them can be preferably used. A molecular weight of gelatin used is preferably from 10,000 to 1,000,000. Modified gelatin, which is obtained by modifying a gelatin utilizing an amino group or a carboxy group of gelatin (e.g., phthalated gelatin or the like), can be also used. As gelatin, there can be used an inert gelatin (e.g., Nitta gelatin 750), a phthalated gelatin (e.g., Nitta gelatin 801), and the like.

In an aqueous gelatin solution, solation occurs when gelatin is heated to 30° C. or higher, and gelation occurs and the solution loses fluidity when it is cooled to lower than 30° C. As this sol-gel exchange occurs reversibly, an aqueous gelatin solution as a coating solution has a setting ability. That means gelatin solution loses fluidity when it is cooled to lower than 30° C.

Further, the hydrophilic polymer derived from animal protein can be used in combination with the following hydrophilic polymer which is not derived from animal protein or a hydrophobic polymer.

The hydrophilic polymer which is not derived from animal protein according to the present invention means a natural polymer (polysaccharide series, microorganism series, or animal series) other than animal protein such as gelatin or the like, a semi-synthetic polymer (cellulose series, starch series, or alginic acid series), and a synthetic polymer (vinyl series or others) and corresponds to synthetic polymer such as poly(vinyl alcohol) described below and natural or semi-synthetic polymer made by cellulose or the like derived from plant as a raw material. Poly(vinyl alcohols) and acrylic acid-vinyl alcohol copolymers are preferable.

The hydrophilic polymer which is not derived from animal protein has no setting ability, but when it is used in combination with the gelling agent, this has a setting ability and thus, coating ability becomes preferable.

As the hydrophobic polymer, a polymer which is dispersible to an aqueous solvent is preferred. Particularly preferable hydrophobic polymer is a polymer latex containing a fluorine atom described below.

<<Polymer Latex Containing a Fluorine Atom>>

In the present invention, the polymer latex containing a fluorine atom has at least a monomer component represented by the following (M2):

(M2) is a monomer containing a fluorine atom and having an unsaturated bond which performs radical polymerization.

The polymer preferably contains the monomer component represented by (M2) in an amount of 5% by weight or more, and more preferably 20% by weight or more.

It is more preferred that the above-described fluorine atom-containing polymer latex further contains a monomer component represented by the following (M1):

(M1) is a monomer having a salt forming group, or a poly(alkylene oxide) group and having an unsaturated bond which performs radical polymerization.

Further, it is even more preferred that the fluorine atom-containing polymer latex has a monomer component (M3) which is different from either of (M1) and (M2) described above.

In the fluorine atom-containing polymer latex, a content of the monomer component represented by formula (M1) described above is preferably within a range of from 0.1% by weight to 20% by weight, and more preferably from 0.5% by weight to 10% by weight. In the fluorine atom-containing polymer latex, a content of the monomer component represented by formula (M3) that has an unsaturated bond which performs radical polymerization and is different from either of (M1) and (M2) described above is preferably within a range of from 0.5% by weight to 95% by weight, and more preferably from 5.0% by weight to 80% by weight.

In the fluorine atom-containing polymer latex, (M1): (M2): (M3)=0% by weight to 20% by weight: 5% by weight to 100% by weight: 0% by weight to 95% by weight is preferable, and more preferable is (M1): (M2) (M3)=0% by weight to 10% by weight: 20% by weight to 100% by weight 0% by weight to 80% by weight.

As the monomer having a salt forming group in (M1), an anionic monomer, a cationic monomer, and an amphoteric monomer are described; and as the monomer having a poly(alkylene oxide) group in (M1), a nonionic monomer can be described. In more detail, examples of the anionic monomer include an unsaturated carboxylic acid monomer, an unsaturated sulfonic acid monomer, an unsaturated phosphoric acid monomer, and the like; examples of the cationic monomer include an unsaturated tert-amine-containing monomer, an unsaturated ammonium salt-containing monomer, and the like; examples of the amphoteric monomer include N-(3-sulfopropyl)-N-(methacryloyloxy)ethyl-N,N-dimethylammonium betaine, N-(3-sulfopropyl)-N-(methacryloylamino)propyl-N,N-dimethyl ammonium betaine, 1-(3-sulfopropyl)-2-vinyl pyridinium betaine, and the like; examples of the nonionic monomer include an unsaturated poly(oxyethylene oxide) monomer, an unsaturated poly(oxypropylene oxide) monomer, and the like.

Specifically, concerning the anionic monomer, examples of the unsaturated carboxylic acid monomer include acrylic acid, methacrylic acid, crotonic acid, itaconic acid, maleic acid, fumaric acid, their anhydrides, and their monoalkyl esters, and examples of the vinyl ethers having a carboxy group include carboxyethyl vinylether, carboxypropyl vinylether, and the like.

Examples of the unsaturated sulfonic acid monomer include styrene sulfonic acid, 2-acrylamido-2-methylpropane sulfonic acid, 3-sulfopropyl methacrylic acid ester, bis-(3-sulfopropyl)-itaconic acid ester, and the like, and salts thereof, and also sulfuric acid monoester of 2-hydroxyethyl methacrylic acid and a salt thereof.

Examples of the unsaturated phosphoric acid monomer include vinyl phosphonic acid, vinyl phosphate, acid phosphoxyethyl methacrylate, acid phosphoxypropyl methacrylate, bis(methacryloyloxyethyl) phosphate, diphenyl-2-(methacryloyloxyethyl) phosphate, diphenyl-2-(methacryloyloxy)ethyl phosphate, dibutyl-2-(methacryloyloxyethyl) phosphate, dibutyl-2-(acryloyloxyethyl)phosphate, dioctyl-2-(methacryloyloxyethyl)phosphate, and the like.

Examples of the cationic monomer include unsaturated tert-amine-containing monomer, unsaturated ammonium salt-containing monomer, and the like. Specifically, examples include mono-vinyl pyridines such as vinyl pyridine, 2-methyl-5-vinyl pyridine, 2-ethyl-5-vinyl pyridine, and the like; styrenes having a dialkyl amino group such as N,N-dimethylamino styrene, and N,N-dimethylamino methyl styrene; esters having a dialkylamino group of acrylic acid or methacrylic acid such as N,N-dimethylaminoethyl methacrylate, N,N-dimethylaminoethyl acrylate, N,N-diethylaminoethyl methacrylate, N,N-diethylaminoethyl acrylate, N,N-dimethylaminopropyl methacrylate, N,N-dimethylaminopropyl acrylate, N,N-diethylaminopropyl methacrylate, N,N-diethylaminopropyl acrylate; vinyl ethers having a dialkylamino group such as 2-dimethylaminoethyl vinyl ether; acrylamides or methacrylamides having a dialkylamino group such as N—(N',N'-dimethylaminoethyl)methacrylamide, N—(N',N'-dimethylaminoethyl) acrylamide, N—(N',N'-diethylaminoethyl)methacrylamide, N—(N',N'-diethylaminoethyl)acrylamide, N—(N',N'-dimethylaminopropyl) methacrylamide, N—(N',N'-dimethylaminopropyl)acrylamide, N—(N',N'-diethylaminopropyl) methacrylamide, N—(N',N'-diethylaminopropyl) acrylamide; and quaternized compounds thereof by well-known quaternizing agent such as a halogenated alkyl compound (with an alkyl group having 1 to 18 carbon atoms, and as halogen, chloride, bromide, or iodide), halogenated benzyl compounds such as, for example, benzyl chloride, or benzyl bromide, alkyl esters (with an alkyl group having 1 to 18 carbon atoms) of alkylsulfonic acid or arylsulfonic acid such as methane sulfonic acid, benzenesulfonic acid, or toluenesulfonic acid, and dialkylsulfate (with alkyl groups having 1 to 4 carbon atoms).

Examples of the nonionic monomer include esters of unsaturated carboxylic acid monomer and poly(alkylene oxide) addition product with polyoxyalkylene glycol or lower alcohols, and the reaction products of allylglycidyl ether or glycidyl ether of unsaturated carboxylic acid monomer and poly(oxyalkylene oxide) addition product with polyoxyalkylene glycol or lower alcohols. For example, the compounds represented by the following formulae can be used.

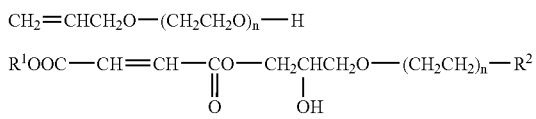

(in the formula $R^1$ is H, $CH_3$ or

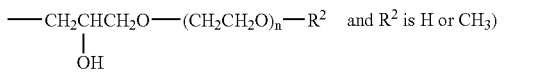

and $R^2$ is H or $CH_3$)

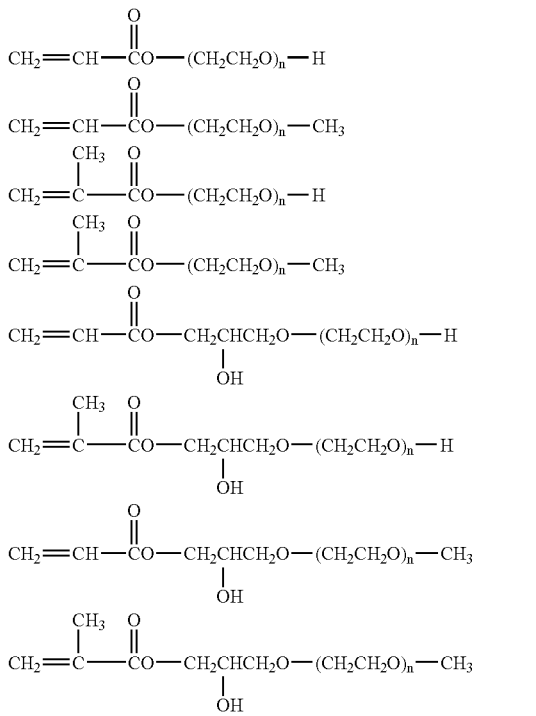

(In the above formulae, n is an integer of from 2 to 100)

In the present invention, as the monomer (M2), well-known compounds having polyfluoroalkyl group or perfluoroalkyl group, such as methacrylate, vinyl ester, vinyl ether, maleate, fumaleate, or α-olefin are described. More preferably, examples of the fluorine-containing monomer include monomers having a polyfluoroalkyl group or a perfluoroalkyl group with 4 or more carbon atoms.

Examples of these compounds are shown below, but the invention is not limited in these.

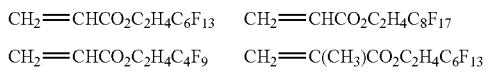

-continued

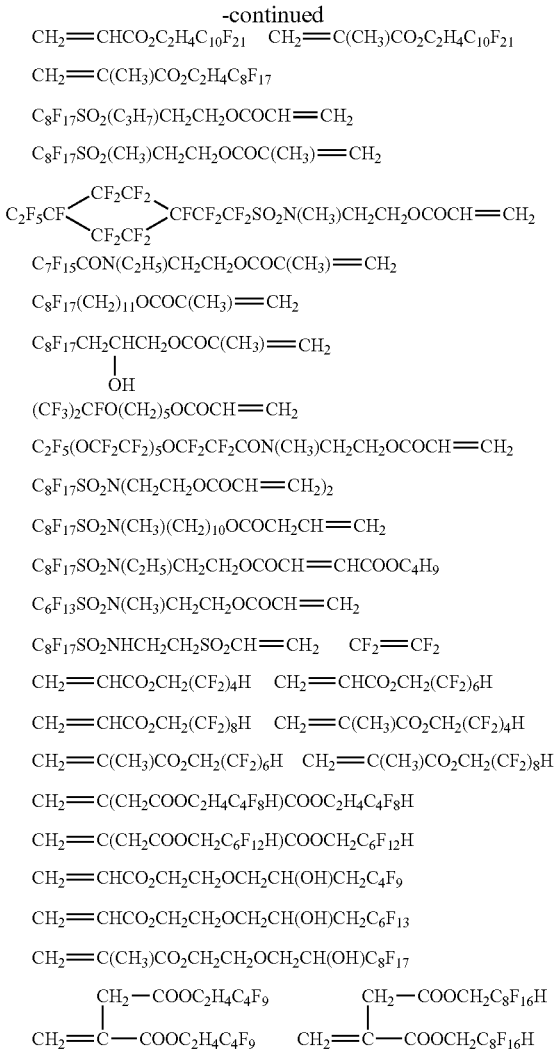

Moreover, a macro monomer of the monomer described above is included. Preparation of the macro monomer can be easily performed by well-known recipes in the art.

For example, the above monomer is subjected to radical polymerization with thioglycolic acid, 2-mercapto ethanol, and the like in the presence of an initiator, and then an unsaturated bond which performs radical polymerization is introduced into one terminal end by reacting the resulting reaction products with glycidyl methacrylate, isocyanato ethyl methacrylate, and the like to form the above macro monomer.

The number-average molecular weight of the macro monomer is preferably 10,000 or less, and more preferably 5,000 or less.

Examples of the monomer (M3), that has unsaturated bond which performs radical polymerization and is different from either of the monomer (M1) and the monomer (M2), include well-known compounds such as methacrylate, vinyl ester, vinyl ether maleate, fumaleate, α-olefin, and the like.

Specific examples of these compounds include vinyl esters such as vinyl acetate, vinyl propionate, vinyl butyrate, vinyl pivalate, vinyl capronate, vinyl laurate, vinyl versate, vinyl cyclohexene carboxylate, or the like; vinyl ethers such as methyl vinyl ether, ethyl vinyl ether, n-propyl vinyl ether, isopropyl vinyl ether, n-butyl vinyl ether, isobutyl vinyl ether, t-butyl vinyl ether, n-pentyl vinyl ether, n-hexyl vinyl ether, n-octyl vinyl ether, 2-ethylhexyl vinyl ether, cyclohexyl vinyl ether, lauryl vinyl ether, or the like; mono-olefins such as ethylene, propyrene, or the like; maleates such as dimethyl maleate, diethyl maleate, dioctyl maleate, or the like; di-olefins such as butadiene, isoprene, or the like; allyl compounds such as allyl acetate, or the like; methacrylate esters such as methyl methacrylate, ethyl methacrylate, n-butyl methacrylate, isobutyl methacrylate, 2-ethylhexyl methacrylate, n-octyl methacrylate, decyl methacrylate, dodecyl methacrylate, or the like; styrene monomers such as styrene, vinyl toluene, or the like; monomers such as acrylonitrile, or the like. And in addition to the above, macro monomers of the monomer described above is included.

Preparation of the macro monomer can be easily performed according to the well-known recipes in the art.

For example, the monomer described above is subjected to radical polymerization with thioglycol acid, 2-mercapto ethanol, and the like in the presence of an initiator, and then a radical polymerizable unsaturated bond is introduced into one terminal end by reacting the resultant reaction products with glycidyl methacrylate, isocyanato ethyl methacrylate, and the like to form the above macro monomer.

The monomer used can be selected from one, or two or more types of monomers mentioned above.

The monomer (M2) preferably contains a repeating unit A derived from a monomer of fluorine atom-containing acrylate or a monomer of fluorine atom-containing methacrylate.

Specifically, the repeating unit A can be derived from fluoromethacrylate represented by the following formula (P) or a mixture of fluoromethacrylate:

$$(Rf)pLOCOCR{=}CH_2 \qquad \text{Formula (P)}$$

wherein the substituent Rf represents a monovalent aliphatic organic group having 1 to 20 carbon atoms, more preferably 2 to 10 carbon atoms, and a fluorine atom. The backbone chain of Rf may be a straight chain, a branched chain, or a cyclic chain, and can contain a quaternary divalent oxygen atom or a trivalent nitrogen atom bonded only to the carbon atom directly. Rf is preferably completely fluorinated, but a hydrogen atom or a chlorine atom bonded to the carbon atom may be present as a substituent of the backbone chain of Rf. Rf preferably contains at least one perfluoromethyl terminal group. p is preferably 1 or 2.

The bonding group L represents a linking group having 1 to 12 carbon atoms. L may be arbitrary substituted and/or interrupted by a substituent with another atom such as O, P, S, or N, or an unsubstituted group. R represents one selected from a hydrogen atom or a methyl group. The mentioned fluoromethacrylate monomer preferably contains 30% by weight or more of fluorine atoms.

One example of the fluoromethacrylate useful for the present invention includes the compound described below:

$$CF_3(CF_2)x(CH_2)yOCOCR{=}CH_2$$

wherein x represents an integer of from 0 to 20, and more preferably an integer of from 2 to 10; y represents an integer of from 1 to 10; and R represents a hydrogen atom or a methyl group;

$$HCF_2(CF_2)xCH_2)yOCOCR{=}CH_2$$

wherein x represents an integer of from 0 to 20, and preferably an integer of from 2 to 10; y represents an integer of from 1 to 10; and R represents a hydrogen atom or a methyl group;

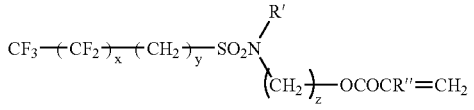

wherein x represents an integer of from 0 to 20, and preferably an integer of from 2 to 10; y represents an integer of from 1 to 10; z represents an integer of from 1 to 4; R' represents an alkyl group or an aryl alkyl group; and R" represents a hydrogen atom or a methyl group;

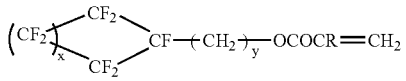

wherein x represents an integer of from 1 to 7; y represents an integer of from 1 to 10; and R represents a hydrogen atom or a methyl group;

$$CF_3(CF_2CF_2O)x(CF_2O)y(CH_2)zOCOCR{=}CH_2$$

wherein x+y represents an integer of from 1 to 20; z represents an integer of from 1 to 10; and R represents a hydrogen atom or a methyl group.

The copolymer according to the present invention may be either a random copolymer, a graft copolymer, or a block copolymer. A molecular weight of the copolymer is preferably, in terms of weight-average molecular weight, in a range of from about 5,000 to about 10,000,000, and more preferably from 5,000 to 1,000,000.

Concerning the polymer composition of the polymer latex containing a fluorine atom according to the present invention, preferred specific examples are shown below. However, the scope of the present invention is not limited to these examples.

TABLE 1

| | FL-1 | FL-2 | FL-3 | FL-4 | FL-5 |
|---|---|---|---|---|---|
| MMA | 50.8 | 49.8 | 0 | 0 | 50.8 |
| LaMA | 0 | 0 | 0 | 22 | 0 |
| EtMA | 0 | 0 | 85 | 0 | 0 |
| Fluorine atom-containing monomer-1 | 41.2 | 48.2 | 7 | 70 | 36.2 |
| 2-Acrylamido-2-methylpropanesulfonic acid | 8 | 0 | 0 | 0 | 0 |
| Acrylic acid | 0 | 2 | 8 | 0 | 8 |
| (Dimethylamino)ethyl methacrylate | 0 | 0 | 0 | 8 | 0 |
| Glycidyl methacrylate | 0 | 0 | 0 | 0 | 5 |

MMA: Methyl methacrylate
EtMA: Ethyl methacrylate
LaMA: Lauryl methacrylate
Fluorine atom-containing monomer-1: 1H,1H,2H,2H-Heptadecafluorodecyl methacrylate

TABLE 2

| | FL-6 | FL-7 | FL-8 |
|---|---|---|---|
| $CF_3(CF_2)_7CH_2CH_2O{-}CH{=}CH_2$ | 72 | 0 | 0 |
| $CH_3(CH_2)_3{-}O{-}CH{=}CH_2$ | 14 | 0 | 0 |
| Tetrafluoroethylene | 0 | 25 | 0 |
| Propylene | 0 | 25 | 0 |
| Fluorine atom-containing monomer-2 | 0 | 0 | 50 |

TABLE 2-continued

| | FL-6 | FL-7 | FL-8 |
|---|---|---|---|
| Graft monomer-3 | 0 | 0 | 40 |
| Acrylic acid | 0 | 50 | 0 |
| Maleic anhydride | 14 | 0 | 0 |
| Methacrylic acid | 0 | 0 | 10 |

Fluorine atom-containing monomer-2

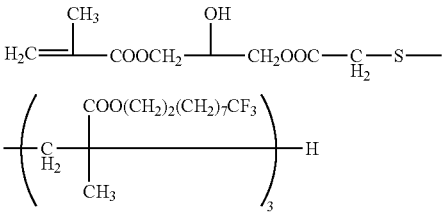

Graft monomer-3

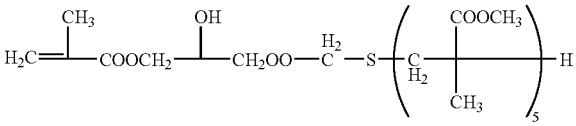

TABLE 3

| | | | | |
|---|---|---|---|---|
| MMA | 46.0 | 42.2 | 35.5 | 19.4 |
| BuA | 46.0 | 44.8 | 41.5 | 0 |
| Fluorine atom-containing monomer-4 | 5.0 | 10.0 | 20.0 | 40.0 |
| N-Methylolacrylamide | 1.0 | 1.0 | 1.0 | 1.0 |
| 2-Ethylhexyl acrylate | 0 | 0 | 0 | 37.6 |
| Acrylic acid | 2.0 | 2.0 | 2.0 | 2.0 |

BuA: Butyl acrylate
Fluorine atom-containing monomer-4: 2,2,2-Trifluoroethyl methaclate

TABLE 4

| | FL-13 | FL-14 | FL-15 | FL-16 | FL-17 | FL-18 |
|---|---|---|---|---|---|---|
| Fluorine atom-containing monomer-5 | 5 | 15 | 25 | 20 | 5 | 10 |
| n-Butyl methacrylate | 90 | 60 | 65 | 70 | 83 | 78 |
| t-Butyl methacrylate | 0 | 20 | 0 | 0 | 0 | 0 |
| 2-Hydroxyethyl methacrylate | 0 | 0 | 5 | 5 | 10 | 10 |
| Acrylic acid | 5 | 5 | 5 | 5 | 2 | 2 |

Fluorine atom-containing monomer-5: β-(Perfluorooctyl) ethyl acrylate

FL-19:33 parts of β-(perfluorooctyl) ethyl acrylate, 34 parts of β-(perfluorodecyl) ethyl acrylate, and 33 parts pf β-(perfluorododecyl) ethyl acrylate Synthetic examples of some of the above specific examples are described.

Synthesis of FL-1

Into the reaction vessel with a stirrer, a reflux condenser, a dropping funnel, a thermometer, and a nitrogen gas inlet tube were added 64 parts of isopropyl alcohol, 4 parts of ion-exchange water, 14.8 parts of methyl methacrylate, 41.2 parts of 1H,1H,2H,2H-heptadecafluorodecyl methacrylate, and 8 parts of 2-acrylamido-2-methylpropane sulfonic acid, while the dissolved oxygen was removed by bubbling of nitrogen gas.

On the other hand, 36 parts of dissolved-oxygen-removed isopropyl alcohol, 36 parts of methyl methacrylate and 0.07 parts of azobis-isobutyronitrile were added into the dropping funnel. After the temperature of the vessel was heated to 83±3° C., 2 parts of methyl ethyl ketone containing 0.13 parts of azobis-isobutyronitrile was added to the mixture, and the monomer was dropped from the dropping funnel in accordance with the consumption speed of the methyl methacrylate. After the finish of dropping the monomer, 3 parts of methyl ethyl ketone prepared by dissolving 0.2 parts of azobis-isobutyronitrile was added thereto and the reaction was continued over a period of 2 hours. Thereafter, 2 parts of methyl ethyl ketone prepared by dissolving 0.1 parts of azobis-isobutyronitrile was added and the reaction was continued over a period of 6 hours to give a homogeneous copolymer.

Thereafter, 15.5 parts of a 10% by weight aqueous solution of sodium hydroxide was added to the resultant copolymer to neutralize, and then 300 parts of ion-exchange water was added. The remaining methyl ethyl ketone was removed under the reduced pressure to obtain an aqueous dispersion of polymer FL-1 of the present invention.

Synthesis of FL-7

Into 1 liter stainless-steel autoclave with stirrer were added 450 parts of dissolved-oxygen-removed methyl ethyl ketone and 5 parts of acrylic acid, and the inner gas was replaced by a nitrogen gas. After the inner gas was replaced by tetrafluoroethylene, the mixed monomer of propylene/tetrafluoroethylene=60 mol %/40 mol % was poured in the mixture and the inner pressure was set to 4.9 MPa.

The temperature was elevated after the start of stirring, and when the inner temperature reached to 70° C., 10 parts of methyl ethyl ketone prepared by dissolving 0.9 parts of benzoyl peroxide was poured and the mixed monomer having the same composition as the above was added while keeping the inner pressure at 13.7 MPa. Thereafter 145 parts of acrylic acid was added over a period of 8 hours. While keeping the inner temperature at 75° C., each monomer was added in accordance with the consumption speed of propylene and tetrafluoroethylene, during the process the inner pressure was kept in a range of from 12.7 Mpa to 13.7 MPa. Thereafter, at 3 hours later and at 6 hours later, 10 parts of methyl ethyl ketone prepared by dissolving 0.9 parts of benzoyl peroxide was added respectively and then after the reaction was continued over a period of 12 hours, the autoclave was cooled down and the volatile substances were evaporated, while the consumption amount of the mixed monomer reached to approximately 150 parts.

A composition of the obtained copolymer was measured by NMR method and the measurement resulted in a composition such as tetrafluoroethylene/propyrene/acrylic acid=25% by weight/25% by weight/50% by weight.

Thereafter, to 100 parts of the copolymer (solid content: 38.5 parts), 27 parts of triethylamine and 160 parts of ion-exchange water were added and then the remaining methyl ethyl ketone was removed under a reduced pressure to obtain an aqueous dispersion of polymer FL-7 of the present invention.

The synthesizing method of the polymer latex used for the present invention is not restricted to the above procedures, and any well-known method can be applied. Details can be referred to the literature described in JP-A Nos. 2-147601, 5-17538, 8-208936, and 11-288061.

The solvent of the coating solution for the outermost layer may be either an organic solvent or an aqueous solvent, but an aqueous solvent is preferred. In the case of the aqueous solvent, the copolymer according to the present invention is preferably used in the form of polymer latex and can be easily added to the coating solution.

The mean particle diameter and the particle diameter distribution of the dispersed particles of polymer latex are the same as those described in the explanation of "polymer latex" described below.

The term "an aqueous solvent" means a solvent consisted of water; or a mixture of water and 70% by weight or less of a water-miscible organic solvent. Examples of the water-miscible organic solvents include alcohols such as methyl alcohol, ethyl alcohol, or propyl alcohol, cellosolves such as methyl cellosolve, ethyl cellosolve, or butyl cellosolve, ethyl acetate, dimethyl formamide, and the like.

The copolymer according to the present invention may be used in combination with hydrophilic polymer such as gelatin, poly(vinyl alcohol), methyl cellulose, hydroxypropyl cellulose, carboxymethyl cellulose, or the like, or in combination with the latex polymer described below, as a binder.

When the above-mentioned polymer latex is used, the content of polymer is preferably from 20% by weight to 100% by weight, and more preferably from 30% by weight to 100% by weight, with respect to total binder.

The coating amount of the polymer is preferably in a range from 0.05 $g/m^2$ to 2.0 $g/m^2$, and more preferably from 0.1 $g/m^2$ to 1.0 $g/m^2$.

3) Auxiliary Additives

The intermediate layer and the outermost layer according to the present invention can contain various auxiliary additives, other than the binder, depending on the purpose.

<Gelling Agent>

The gelling agent according to the present invention is a compound which generates gelation to a solution when it is added into an aqueous solution of the hydrophilic polymer that is not derived from an animal protein or an aqueous latex solution of the hydrophobic polymer and cooled, or a compound which generates gelation when it is used in combination with the gelling accelerator. Fluidity remarkably decreases by the occurrence of gelation.

The following water-soluble polysaccharides can be described as the specific examples of the gelling agent. Namely these are at least one selected from the group consisting of agar, κ-carrageenan, ι-carrageenan, alginic acid, alginate, agarose, furcellaran, jellan gum, glucono-δ-lactone, azotobactor vinelandii gum, xanthan gum, pectin, guar gum, locust bean gum, tara gum, cassia gum, glucomannan, tragacanth gum, karaya gum, pullulan, gum arabic, arabinogalactan, dextran, sodium carboxymethyl cellulose, methyl cellulose, cyalume seed gum, starch, chitin, chitosan, and curdlan.

As the compound which gelates by cooling after melted by heating, agar, carrageenan, jellan gum, and the like are included.

Among these gelling agents, κ-carrageenan (e.g., K-9F produced by DAITO Co.: K-15, 21, 22, 23, 24 and 1-3 produced by NITTA GELATIN Co.), ι-carrageenan, and agar are preferable, and κ-carrageenan is particularly preferable.

The gelling agent is preferably used in a range of from 0.01% by weight to 10.0% by weight, preferably from 0.02% by weight to 5.0% by weight, and more preferably from 0.05% by weight to 2.0% by weight, with respect to the binder polymer.

<Gelling Accelerator>

The gelling agent is preferably used with a gelling accelerator. A gelling accelerator according to the present invention is a compound which accelerates gelation by contact with a gelling agent, whereby the gelling function can be developed by specific combination with the gelling agent. In the present invention, the combinations of the gelling agent and the gelling accelerator such as shown below can be used.

A combination of alkali metal ions such as potassium ion or the like or alkali earth metal ions such as calcium ion, magnesium ion, or the like as the gelling accelerator and carrageenan, alginate, azotobactor vinelandii gum, pectin, carboxymethyl cellulose sodium salt, or the like, as the gelling agent.

A combination of boric acid or other boron compounds as the gelling accelerator and guar gum, locust bean gum, tara gum, cassia gum, or the like as the gelling agent;

A combination of acids or alkali compounds as the gelling accelerator and alginate, glucomannan, pectin, chitin, chitosan, curdlan, or the like as the gelling agent;

A water-soluble polysaccharides which forms gel by reaction with the gelling agent is used as the gelling accelerator. As typical examples, the combination of xanthan gum as the gelling agent and cassia gum as the gelling accelerator, and the combination of carrageenan as the gelling agent and locust bean gum as the gelling accelerator;

and the like are illustrated.

As the typical examples of the combination of these gelling agents and gelling accelerators, the following combinations a) to g) can be described.

a) Combination of κ-carrageenan and potassium;
b) combination of ι-carrageenan and calcium;
c) combination of low methoxyl pectin and potassium;
d) combination of sodium alginate and potassium;
e) combination of locust bean gum and xanthan gum;
f) combination of jellan gum and acid;
g) combination of locust bean gum and xanthan gum.

These combinations may be used simultaneously as plural combinations.

Although the gelling accelerator can be added to the same layer in which the gelling agent is added, it is preferably added in a different layer as to react. It is more preferable to add the galation accelerator to the layer not directly adjacent to the layer containing the gelling agent. Namely, it is more preferable to set a layer not containing any of the gelling agent and the gelling accelerator between the layer containing the gelling agent and the layer containing the gelling accelerator.

The gelling accelerator is used in a range of from 0.1% by weight to 200% by weight, and preferably from 1.0% by weight to 100% by weight, with respect to the gelling agent.

In the layer containing hydrophilic polymer, other additives can be added, if necessary. As these additives, there are described a surfactant, a pH control agent, an antiseptic, a rust-preventing agent, a dye, a pigment, a color-tone-adjusting agent, and the like.

<Auxiliary Film-Forming Agent>

To control the minimum film-forming temperature, an auxiliary film-forming agent may be added. The auxiliary film-forming agent is also called a temporally plasticizer and is the compound (usually an organic solvent) which makes a minimum film-forming temperature of polymer latex decrease and for instance, is described in the above "GOUSEI LATEX NO KAGAKU" (Soichi Muroi, published by Kobunshi Kankokai (1970)). The preferred auxiliary film-forming agents are the following compounds, but the compound usable in the present invention is not limited in the following specific examples.

Z-1: Benzyl alcohol,

Z-2: 2,2,4-trimethylpentanediol-1,3-monoisobutyrate,

Z-3: 2-dimethylaminoethanol,

Z-4: diethylene glycol.

<Crosslinking Agent>

In the present invention, a crosslinking agent is preferably added in any layer on the side having thereon the image forming layer, and more preferably a crosslinking agent is added in the layer containing a hydrophilic polymer such as the non-photosensitive intermediate layer A or the like. By adding a crosslinking agent, an excellent photothermographic material having a non-photosensitive intermediate layer exhibiting a good degree of hydrophobic property and water resistance is obtained.

As the crosslinking agent, it is enough that the crosslinking agent has plural groups, which react with an amino group or a carboxy group, in a molecule, and the species of the crosslinking agent are not particularly limited. Examples of the crosslinking agent are described in T. H. James, "THE THEORY OF THE PHOTOGRAPHIC PROCESS, FOURTH EDITION" (Macmillan Publishing Co., Inc., pages 77 to 87, 1977). Both of a crosslinking agent of an inorganic compound (for example, chrome alum) and a crosslinking agent of an organic compound are preferred, but more preferred is a crosslinking agent of organic compound.

As the crosslinking agent for the layer containing a hydrophobic polymer such as the non-photosensitive intermediate layer B or the like, it is enough that the crosslinking agent has plural groups, which react with a carboxy group, in a molecule, and the species of the crosslinking agent are not particularly limited.

As preferable organic compounds of the crosslinking agent, carboxylic acid derivatives, carbamic acid derivatives, sulfonate ester compounds, sulfonyl compounds, epoxy compounds, aziridine compounds, isocyanate compounds, carbodiimide compounds, and oxazoline compounds can be described. Epoxy compounds, isocyanate compounds, carbodiimide compounds, and oxazoline compounds are more preferred. The crosslinking agent may be used alone or two or more of them may be used in combination.

<Viscosity Increasing Agent>

A viscosity increasing agent is preferably added to a coating solution for forming the non-photosensitive intermediate layer B. By the addition of a viscosity increasing agent, a hydrophobic layer having a uniform thickness can be formed. Examples of the viscosity increasing agent include alkaline metal salts of poly(vinyl alcohol), hydroxyethyl cellulose, and hydroxymethyl cellulose. With regard to the handling property, preferred are compounds having thixotropic property, and therefore, hydroxyethyl cellulose, sodium hydroxymethylcarboxylate, or carboxymethyl-hydroxyethyl cellulose is used.

Viscosity of the coating solution for the non-photosensitive intermediate layer B containing the viscosity increasing agent, measured at 40° C., is preferably from 1 mPa·s to 200 mPa·s, more preferably from 10 mPa·s to 100 mPa·s, and even more preferably from 15 mPa·s to 60 mPa·s.

<Polymer Latex>

Polymer latex used for the binder of the outermost layer of the present invention is explained. The content of polymer latex is preferably 50% by weight or higher, and more preferably in a range of from 50% by weight to 75% by weight.

A polymer latex having an equilibrium water content at 25° C. and 60% RH of 5% by weight or lower is preferred. The term "equilibrium water content at 25° C. and 60% RH" referred herein is expressed as follows:

$$\text{Equilibrium water content at 25° C. and 60\% RH} = [(W1-W0)/W0]\times 100 \text{ (\% by weight)}$$

wherein W1 is the mass of the polymer in moisture-controlled equilibrium under the atmosphere of 25° C. and 60% RH, and W0 is the absolutely dried mass at 25° C. of the polymer.

The equilibrium water content in the present invention is more preferably 2% by weight or lower, and is even more preferably, in a range of from 0.01% by weight to 1.5% by weight, and is most preferably, from 0.02% by weight to 1% by weight.

The glass transition temperature (Tg) of the polymer latex according to the present invention is preferably in a range of from 0° C. to 80° C., more preferably from 10° C. to 70° C. and, even more preferably from 15° C. to 60° C.

Specific examples of the polymer latex which can be used in the present invention include latexes of polyacrylate, polyurethane, polymethacrylate, and copolymers including these.

The polymer latex which can be used in the present invention may be of two or more of them depending on needs. And, the polymer latex having Tg of 20° C. or higher and the polymer latex having Tg of lower than 20° C. may be used in combination. In the case where two or more polymers differing in Tg may be blended for use, it is preferred that the weight-average Tg is in the range mentioned above.

In the invention, a layer containing hydrophobic polymer is preferably formed by applying a coating solution containing 30% by weight or more of water in the solvent and by then drying.

A preferred embodiment of the polymer latex according to the present invention is such prepared to yield an ion conductivity of 2.5 mS/cm or lower, and as such a preparing method, there can be mentioned a refining treatment using a separation function membrane after synthesizing the polymer.

As a coating solvent, water or water containing mixed therein 70% by weight or less of a water-miscible organic solvent is preferred. As water-miscible organic solvent, there can be described, for example, alcohols such as methyl alcohol, ethyl alcohol, propyl alcohol, and the like; cellosolves such as methyl cellosolve, ethyl cellosolve, butyl cellosolve, and the like; ethyl acetate; dimethylformamide, and the like.

In the invention, a mean particle diameter of the polymer latex is preferably in a range of from 1 nm to 50,000 nm, more preferably from 10 nm to 500 nm, and even more preferably from 50 nm to 200 nm. There is no particular limitation concerning a particle diameter distribution of the dispersed particles, and the particles may be widely distributed or may exhibit a monodispersed particle diameter distribution. From the viewpoint of controlling the physical properties of the coating solution, preferred mode of usage includes mixing two or more types of dispersed particles each having a monodispersed particle diameter distribution.

As the polymer, hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like can be used preferably. As the polymers above, usable are straight chain polymers, branched polymers, or crosslinked polymers; also usable are the so-called homopolymers in which one type of monomer is polymerized, or copolymers in which two or more types of monomers are polymerized. In the case of copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

NP-1; Latex of -MMA(70)-EA(27)-MAA(3)-(molecular weight 37000, Tg 61° C.)

NP-2; Latex of -MMA(70)-2EHA(20)-St(5)-AA(5)-(molecular weight 40000, Tg 59° C.)

NP-3; Latex of -St(55)-Bu(42)-MAA(3)-(crosslinking, Tg 5° C.)

NP-4; Latex of -St(68)-Bu(29)-AA(3)-(crosslinking, Tg 17° C.)

NP-5; Latex of -St(71)-Bu(26)-AA(3)-(crosslinking, Tg 24° C.)

NP-6; Latex of -St(70)-Bu(27)-IA(3)-(crosslinking)

NP-7; Latex of -St(75)-Bu(24)-AA(1)-(crosslinking, Tg 29° C.)

NP-8; Latex of -St(60)-Bu(35)-DVB(3)-MAA(2)-(crosslinking)

NP-9; Latex of -St(70)-Bu(25)-DVB(2)-AA(3)-(crosslinking)

NP-10; Latex of -VC(50)-MMA(20)-EA(20)-AN(5)-AA(5)-(molecular weight 80000)

NP-11; Latex of -VDC(85)-MMA(5)-EA(5)-MAA(5)-(molecular weight 67000)

NP-12; Latex of -Et(90)-MAA(10)-(molecular weight 12000)

NP-13; Latex of -St(70)-2EHA(27)-AA(3)-(molecular weight 130000, Tg 43° C.)

NP-14; Latex of -MMA(63)-EA(35)-AA(2)-(molecular weight 33000, Tg 47° C.)

NP-15; Latex of -St(70.5)-Bu(26.5)-AA(3)-(crosslinking, Tg 23° C.)

NP-16; Latex of -St(69.5)-Bu(27.5)-AA(3)-(crosslinking, Tg 20.5° C.)

NP-17; Latex of -St(61.3)-Isoprene(35.5)-AA(3)-(crosslinking, Tg 17° C.)

NP-18; Latex of -St(67)-Isoprene(28)-Bu(2)-AA(3)-(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

As the polymer latex used for the hydrophobic polymer layer of the present invention, particularly, latexes of acrylate copolymer, latexes of polyester, polyurethane, and the like are preferred. Further, the polymer latex used for the hydrophobic polymer layer of the present invention preferably contains acrylic acid or methacrylic acid within an amount of from 1% by weight to 6% by weight, and more preferably from 2% by weight to 5% by weight. The polymer latex used for the hydrophobic polymer layer of the invention preferably contains acrylic acid.

The coating amount of the hydrophobic polymer is preferably from 0.1 $g/m^2$ to 10 $g/m^2$ per 1 $m^2$ of the support, and more preferably from 0.3 $g/m^2$ to 5 $g/m^2$.

It is preferred that the concentration of the hydrophobic polymer in a coating solution is arranged to have suitable viscosity for simultaneous multilayer coating after the addition, but it is not specifically limited. Generally, the concentration of the hydrophobic polymer in a coating solution is from 5% by weight to 50% by weight, and is preferably from 10% by weight to 40% by weight, and particularly preferably from 15% by weight to 30% by weight.

<Matting Agent>

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range of from 1 $mg/m^2$ to 400 $mg/m^2$, and more preferably, from 5 $mg/m^2$ to 300 $mg/m^2$, with respect to the coating amount per 1 $m^2$ of the photothermographic material.

The shape of the matting agent usable in the invention may be a fixed form or non-fixed form. Preferred is to use those having fixed form and globular shape.

Volume weighted mean equivalent spherical diameter of the matting agent used in the image forming layer surface is preferably in a range of from 0.3 μm to 10 μm, and more preferably, from 0.5 μm to 7 μm. Further, the particle distribution of the matting agent is preferably set as such that the variation coefficient becomes from 5% to 80%, and more preferably, from 20% to 80%. The variation coefficient, herein, is defined by (the standard deviation of particle diameter)/(mean diameter of the particle)×100. Furthermore, two or more types of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range of from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more types of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble does not occur, but the level of matting of 30 seconds to 2000 seconds is preferred, particularly preferred, 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more when expressed by Beck's smoothness.

In the present invention, a matting agent is preferably contained in the outermost layer, in a layer which functions as a surface protective layer, or in a layer near to the outermost layer.

<Lubricant>

To improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point, and an ester of a fatty acid having a branch structure and a molecular weight of 1000 or more.

Concerning lubricants, compounds described in paragraph No. 0117 of JP-A No. 11-65021 and in JP-A Nos. 2000-5137, 2004-219794, 2004-219802, and 2004-334077 are preferable.

The addition amount of the lubricant is in a range of from 1 mg/m$^2$ to 200 mg/m$^2$, preferably from 10 mg/m$^2$ to 150 mg/m$^2$, and more preferably in a range of from 20 mg/m$^2$ to 100 mg/m$^2$.

The lubricant is added in any layer of the image forming layer and the non-image-forming layer, but from the purpose to improve transportability and resistance to scratches, it is preferred to add the lubricant in the outermost layer.

<Surfactant>

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material of the invention, the fluorocarbon surfactants described in JP-A Nos. 2002-82411, 2003-57780, and 2003-149766 are preferably used. Especially, the usage of the fluorocarbon surfactants described in JP-A Nos. 2003-57780 and 2003-149766 in an aqueous coating solution is preferred viewed from the standpoint of capacity in static control, stability of the coated surface state and sliding facility. The fluorocarbon surfactant described in JP-A No. 2003-149766 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2003-149766 is effective, and used preferably in a range of from 0.01 mg/m$^2$ to 10 mg/m$^2$, and more preferably, in a range of from 0.1 mg/m$^2$ to 5 mg/m$^2$.

(Image Forming Method)

1) Imagewise Exposure

The photothermographic material of the invention may be subjected to imagewise exposure by any known methods. Preferably, the photothermographic material of the present invention is subjected to scanning exposure using a laser beam. As the laser beam which can be used in the invention, He—Ne laser of red through infrared emission, red laser diode, or $Ar^+$, He—Ne, He—Cd laser of blue through green emission, or blue laser diode are described. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C.

Time period for development is preferably from 3 second to 20 seconds, more preferably from 4 seconds to 18 seconds, and even more preferably from 5 seconds to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 steps to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably employed for photothermographic materials for use in medical diagnosis, photothermographic materials for use in industrial photographs, photothermographic materials for use in graphic arts, as well as for COM, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

| <Preparations of coating solution for undercoat layer> | |
|---|---|
| Formula (1) (for undercoat layer on the image forming layer side) | |
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenyl ether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |

-continued

| <Preparations of coating solution for undercoat layer> | |
|---|---|
| Formula (2) (for first layer on the backside) | |
| Styrene-butadiene copolymer latex (solid content of 40% by weight, styrene/butadiene mass ratio = 68/32) | 130.8 g |
| Sodium salt of 2,4-dichloro-6-hydroxy-s-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| Formula (3) (for second layer on the backside) | |
| $SnO_2$/SbO (9/1 by mass ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

<Undercoating>

Both surfaces of the biaxially tentered poly(ethylene terephthalate) support having a thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 8.4 mL/$m^2$, and dried at 180° C. for 6 minutes. Thus, an undercoated support was produced.

(Back Layer)

1) Preparation of Coating Solution for Back Layer 1-1) Preparation of Coating Solution for Antihalation Layer A vessel was kept at 40° C., and thereto were added 50 g of gelatin having an isoelectric point of 4.8 (PZ gelatin, manufactured by Miyagi Chemical Industry Co., Ltd.), 0.1 g of benzoisothiazolinone, and water to allow gelatin to be dissolved. Additionally, 55 mL of a 5% by weight aqueous solution of blue dye-2, 60 mL of a 25% by weight aqueous solution of polymer-B described below as a dye fixing agent, and 50 mL of a 20% by weight liquid of ethyl acrylate/acrylic acid copolymer (mass ratio of the copolymerization of 95/5, the pH was adjusted to 7.0 with aqueous ammonia) latex were admixed to give a coating solution for the antihalation layer in an amount of 600 mL. The pH of the resulting coating solution was 7.3.

1-2) Preparation of Coating Solution for Backside Under Layer of Antihalation Layer A vessel was kept at 40° C., and thereto were added 50 g of gelatin having an isoelectric point of 4.8 (PZ gelatin, manufactured by Miyagi Chemical Industry Co., Ltd.), 0.1 g of benzoisothiazolinone, and 950 mL of water. After allowing gelatin to be dissolved, additionally, 2.3 mL of a 1 mol/L aqueous solution of sodium hydroxide was added and mixed well. Just prior to the coating, 80 mL of a 4% by weight aqueous solution of N,N-ethylenebis(vinylsulfone acetamide) was admixed to give a coating solution for the under layer of antihalation layer in an amount of 1,000 mL. The pH of the resulting coating solution was 6.3.

1-3) Preparation of Coating Solution for Back Surface Protective Layer

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved. Additionally, 8.1 mL of a 1 mol/L sodium acetate aqueous solution, 0.93 g of fine particles of poly(ethylene glycol dimethacrylate-co-methylmethacrylate) (mean particle diameter of 7.7 μm, standard deviation of particle diameter of 0.3), 5 g of a 10% by weight emulsion of liquid paraffin, 10 g of a 10% by weight emulsion of dipentaerythritol hexaisostearate, and 2.3 mL of a 1 mol/L sodium hydroxide were admixed. Further, 10 mL of a 5% by weight aqueous solution of sodium di(2-ethylhexyl)sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight liquid of ethyl acrylate/acrylic acid copolymer (mass ratio of the copolymerization of 95/5, the pH was adjusted to 7.0 with aqueous ammonia) latex were admixed. Just prior to the coating, 50 mL of a 4% by weight aqueous solution of sodium salt of 2,4-dichloro-6-hydroxy-s-triazine was admixed to give coating solution for the back surface protective layer in an amount of 855 mL. The pH of the resulting coating solution was 7.2.

2) Coating of Back Layer

The backside of the undercoated support described above was subjected to simultaneous multilayer coating so that the coating solution for the under layer of the antihalation layer gave the coating amount of gelatin of 0.5 g/$m^2$, the coating solution for the antihalation layer gave the coating amount of gelatin of 0.9 g/$m^2$, and so that the coating solution for the back surface protective layer gave the coating amount of gelatin of 1.1 g/$m^2$, followed by drying to produce a back layer.

(Image Forming Layer, Intermediate Layer, and Surface Protective Layer)

1. Preparations of Coating Material

1) Preparations of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless-steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Further, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1 Silver halide emulsion 3 was obtained similarly to the silver halide emulsion 1 except that: the addition of the methanol solution of the spectral sensitizing dye A and the spectral sensitizing dye B was changed to a solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid 88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a =0.21 μm, b=0.4 μm and c=0.4 μm on the average value, with a mean aspect ratio of 2.1, and a variation coefficient of an equivalent spherical diameter distribution of 11% (a, b and c are as defined aforementioned).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Dispersion A of Silver Salt of Benzotriazole Compound 1 kg of benzotriazole was added to a liquid prepared by dissolving 360 g of sodium hydroxide in 9,100 mL of water, and then the mixture was stirred for 60 minutes. Thereby, solution BT of sodium salt of a benzotriazole compound was prepared.

A liquid prepared by dissolving 55.9 g of alkali-processed de-ionized gelatin in 1,400 mL of distilled water was kept at 70° C. while stirring in a stainless-steel reaction vessel. And then, solution A prepared through diluting 54.0 g of silver nitrate by adding distilled water to give the volume of 400 mL, and solution B prepared through diluting 397 mL of the solution BT of sodium salt of a benzotriazole compound with distilled water to give the volume of 420 mL were added. A method of double jet was executed through adding 220 mL of the solution B at a constant flow rate of 20 mL/min over 11 minutes to the stainless-steel reaction vessel, and at one minute post initiation of the addition of the solution B, 200 mL of the solution A was added thereto at a constant flow rate of 20 mL/min over 10 minutes. Moreover, at 6 minutes later after completing the addition, the solution A and the solution B were added simultaneously at a constant flow rate of 33.34 mL/min over 6 minutes in an amount of 200 mL respectively. The mixture was cooled to 45° C., and 92 mL of Demol N (10% by weight aqueous solution, manufactured by Kao Corporation) was added to the mixture while stirring. The mixture was adjusted to the pH of 4.1 with 1 mol/L sulfuric acid. After stopping stirring, the mixture was subjected to precipitation/desalting/water washing steps.

Thereafter, the resulting mixture was warmed to 50° C. and 51 mL of 1 mol/L sodium hydroxide was added thereto while stirring, and then 11 mL of a 3.5% by weight methanol solution of benzoisothiazolinone and 7.7 mL of a 1% by weight methanol solution of sodium benzenethiosulfonate were added thereto. After stirring the mixture for a period of 80 minutes, the mixture was adjusted to the pH of 7.8 with 1 mol/L sulfuric acid. Thereby, dispersion A of silver salt of a benzotriazole compound was prepared.

Particles of the prepared dispersion of silver salt of a benzotriazole compound had a mean equivalent circular diameter of 0.172 μm, a variation coefficient of an equivalent circular diameter distribution of 18.5%, a mean length of long sides of 0.32 μm, a mean length of short sides of 0.09 μm, and a ratio of the mean length of long sides to the mean length of short sides of 0.298. Particle size and the like were determined from the average of 300 particles using an electron microscope.

4) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resulting reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resulting reducing agent dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparation of Development Accelerator-2 Dispersion

Also concerning solid dispersion of development accelerator-2, dispersion was executed similar to the development accelerator-1, and thus dispersion of 23% by weight was obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Isoprene Latex Liquid

Isoprene latex (TP-2) was prepared as follows.

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless-steel vessel surface and stainless-steel stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, the resulting mixture was filtered with a polypropylene filter having a pore size of 1.0 μm to remove foreign substances such as dust, and stored. 1248 g of isoprene latex TP-2 was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content at 25° C. and 60RH % of 0.4% by weight, and an ionic conductivity of 5.23 mS/cm (measurement of the ionic conductivity was performed using a conductometer CM-30S manufactured by To a Electronics Ltd. at 25° C.).

11) Preparation of SBR Latex Liquid (TP-1)

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex TP-1 was obtained in an amount of 774.7 g.

Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a gelation ratio of 73% by weight, a mean particle diameter of 90 nm, Tg of 17° C., a solid content of 44% by weight, an equilibrium moisture content at 25° C. and 60% RH of 0.6% by weight, and an ionic conductivity of 4.80 mS/cm (measurement of the ionic conductivity was performed using a conductometer CM-30S manufactured by To a Electronics Ltd. at 25° C.).

12) Preparation of Magenta Dye-1 Dispersion

To 1.0 kg of magenta dye-1 and 3.0 kg of a 10% by weight aqueous solution of modified poly(vinyl alcohol) (manufactured by Kuraray Co., Ltd., Poval MP-203) were added 42 g of a 48% by weight aqueous solution of surfactant "PIONIN A-43-S" (trade name, available from Takemoto Oil & Fat Co., Ltd.) and 3.0 g of an antifoaming agent (trade name: SURFYNOL 104E, manufactured by Nissin Chemical Industry Co., Ltd.), and the mixture was thoroughly mixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 1.0 g of a benzoisothiazolinone sodium salt and water were added thereto, thereby adjusting the concentration of the water-insoluble azomethine dye to be 10% by weight. This dispersion was warmed at 40° C. for 2 hours to obtain magenta dye-1 dispersion. Particles of the magenta dye included in the resulting magenta dye-1 dispersion had a median diameter of 0.49 μm, and a maximum particle diameter of 2.6 μm or less. The resulting reducing agent dispersion was subjected to filtration with a polypropylene filter having a pore size of 3.0 μm to remove foreign substances such as dust, and stored.

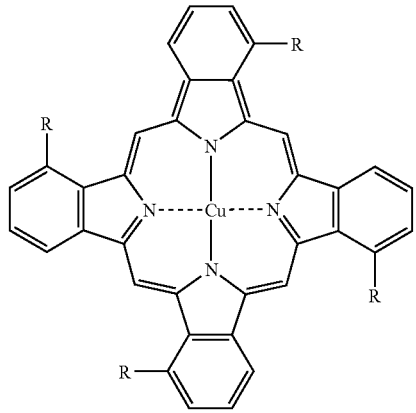

R = $SO_2CH_2CH_2CH_2SO_3Na$

Polymer-B

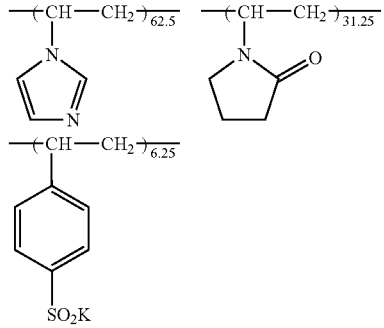

-continued

Magenta dye-1

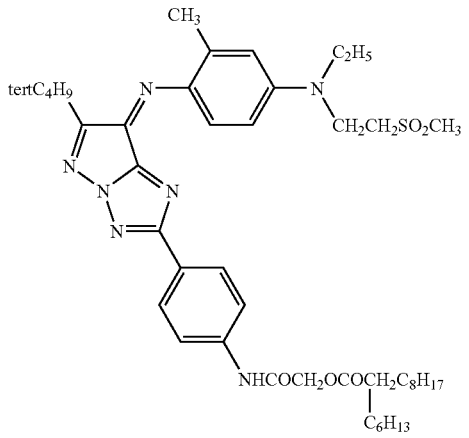

2. Preparations of Coating Solution

1) Preparation of Coating Solution-1 for Image Forming Layer

To the dispersion of the silver salt of a fatty acid obtained as described above in an amount of 1000 g were serially added 264 mL of water, 4.7 g of the magenta dye-1 dispersion, 25 g of a 5% by weight aqueous solution of blue dye-2, 28 g of the organic polyhalogen compound-1 dispersion, 47 g of the organic polyhalogen compound-2 dispersion, 177 g of the phthalazine compound-1 solution, 500 g of the SBR latex liquid (TP-1), 570 g of the isoprene latex liquid (TP-2), 80 g of the reducing agent-1 dispersion, 75 g of the reducing agent-2 dispersion, 4.8 g of the development accelerator-1 dispersion, 2.2 g of the development accelerator-2 dispersion, 4 mL of the mercapto compound-1 aqueous solution, and 4 mL of the mercapto compound-2 aqueous solution. By adding, just prior to the coating, 118 g of the mixed emulsion A for a coating solution thereto and mixing sufficiently, a coating solution for the image forming layer was prepared, and allowed to be transported to a coating die and coated.

Viscosity of the above-described coating solution for the image forming layer was 25 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 35, 37, 34, 25, and 16 [mPa·s], respectively, at the shearing rate of 0.1, 1, 10, 100, 1000 [1/second].

The amount of zirconium in the coating solution was 0.22 mg per 1 g of silver.

2) Preparation of Coating Solution B for Intermediate Layer

To 1000 g of poly(vinyl alcohol) PVA-205 (manufactured by Kuraray Co., Ltd.), 42 mL of a 5% by weight aqueous solution of sodium di(2-ethylhexyl)sulfosuccinate, and 9800 mL of a 19% by weight liquid of methyl methacrylate/styrene/butyl acrylate/hydroxyethyl methacrylate/acrylic acid copolymer (mass ratio of the copolymerization of 57/8/28/5/2) latex (expressed as latex A in Table 5; and type of latex is shown in Table 5) were added 27 mL of a 5% by weight aqueous solution of aerosol OT (manufactured by American Cyanamid Co.), 215 mL of a 20% by weight aqueous solution of diammonium phthalate, and 4000 mL of water. The mixture was adjusted with sodium hydroxide to give the pH of 7.0. Accordingly, the coating solution for the intermediate layer was prepared, and was fed to a coating die to provide 7.8 mL/m$^2$. Preparation was conducted by adequately adjusting the ratio of PVA-205 and the latex as shown in Table 5.

Viscosity of the coating solution was 25 [mPa·s] which was measured with a B type viscometer at 40° C. (No. 1 rotor, 60 rpm).

3) Preparation of Coating Solution for First Layer of Surface Protective Layers

In 704 mL of water were dissolved 100 g of inert gelatin and 10 mg of benzoisothiazolinone, and thereto were added 146 g of the dispersion A of a silver salt of a benzotriazole compound, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 33.9 mL/m$^2$.

Viscosity of the coating solution was 20 [mPa·s] which was measured with a B type viscometer at 40° C. (No. 1 rotor, 60 rpm).

4) Preparations of Coating Solution for Second Layer of Surface Protective Layers In 785 mL of water were dissolved 100 g of inert gelatin and 10 mg of benzoisothiazolinone, and thereto were added 10 g of a 10% by weight emulsion of liquid paraffin, 30 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 11 mL of a 1% by weight solution of a fluorocarbon surfactant (F-1), 11 mL of a 1% by weight aqueous solution of another fluorocarbon surfactant (F-2), 28 mL of a 5% by weight aqueous solution of sodium di(2-ethylhexyl)sulfosuccinate, and 25 g of poly(methyl methacrylate) fine particles (mean particle diameter of 3.6 μm, volume weighted mean distribution of 60%), and the obtained mixture was mixed, which was fed to a coating die so that 4.2 mL/m$^2$ could be provided.

Viscosity of the coating solution was 19 [mPa·s] which was measured with a B type viscometer at 40° C. (No. 1 rotor, 60 rpm).

3. Preparations of Photothermographic Material

1) Preparation of Photothermographic Material-101

Reverse surface of the back surface was subjected to simultaneous multilayer coating by a slide bead coating method in order of the image forming layer, intermediate layer B, first layer of the surface protective layers, and second layer of the surface protective layers, starting from the undercoated face, and thereby sample of photothermographic material was produced. In the process, the temperature of the coating solution was adjusted to 31° C. for the image forming layer and the intermediate layer B, to 36° C. for the first layer of the surface protective layers, and to 37° C. for the second layer of the surface protective layers.

The coating amount of each compound (g/m$^2$) for the image forming layer is as follows.

| | |
|---|---|
| Silver salt of fatty acid | 6.00 |
| Magenta dye-1 | 0.11 |
| Blue dye-2 | 0.029 |
| Organic polyhalogen compound-1 | 0.17 |
| Organic polyhalogen compound-2 | 0.33 |
| Phthalazine compound-1 | 0.20 |
| Isoprene latex | 5.50 |
| SBR latex | 5.10 |
| Reducing agent-1 | 0.46 |
| Reducing agent-2 | 0.43 |
| Development accelerator-1 | 0.022 |
| Development accelerator-2 | 0.012 |
| Mercapto compound-1 | 0.001 |
| Mercapto compound-2 | 0.002 |
| Silver halide (on the basis of Ag content) | 0.15 |

Conditions for coating and drying were as follows.

Coating was performed at the speed of 140 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of the film surface pH at the image forming layer side gave the result of 6.0.

2) Preparations of Photothermographic Material-102 to -109

Preparations of photothermographic material-102 to -109 were conducted in a similar manner to the process in the preparation of photothermographic material-101 except that: the type and the addition amount of the latex included in the intermediate layer B were changed as shown in Table 5; and the silver salt of a benzotriazole compound included in the first layer of the surface protective layers was changed as shown in Table 5.

(Preparations of Dispersion of Organic Silver Salt Other than Silver Salt of Benzotriazole Compound)

<<Silver Behenate Dispersion Same as That for Image Forming Layer>>

To the above-described silver salt of a fatty acid corresponding to 260 kg of a dry solid matter content were added 40 g of a 5% by weight aqueous solution of sodium di(2-ethylhexyl)sulfosuccinate, 80 g of a 5% by weight aqueous solution of inert gelatin, and 20 g of water to give slurry and then the slurry was subjected to preliminary dispersion with a pipeline mixer.

Next, the obtained preliminary dispersion was treated three times using a dispersing machine (trade name: Microfluidizer M-110EH, manufactured by Microfluidex International Corporation, using Z type Interaction Chamber) with the pressure controlled to be 1320 kg/cm$^2$ to give a silver behenate dispersion. For the cooling manipulation, coiled heat exchangers were equipped in front of and behind the interaction chamber respectively, and accordingly, the temperature for the dispersion was set to be 18° C. by regulating the temperature of the cooling medium.

<<Silver Laurate Dispersion>>

Silver laurate dispersion was prepared in a similar manner to the process in the preparation of the silver behenate dispersion described above except that 51.8 kg of lauric acid was used instead of 88 kg of recrystallized behenic acid.

Chemical structures of the compounds used in Examples of the invention are shown below.

Spectral sensitizing dye A

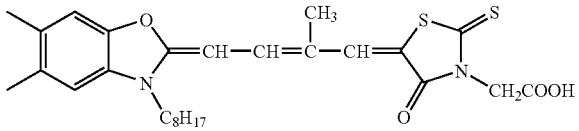

Spectral sensitizing dye B

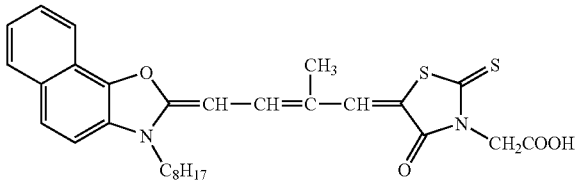

Tellurium sensitizer C

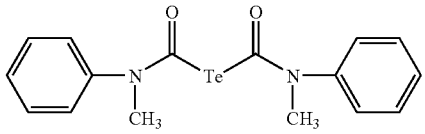

Base precursor-1

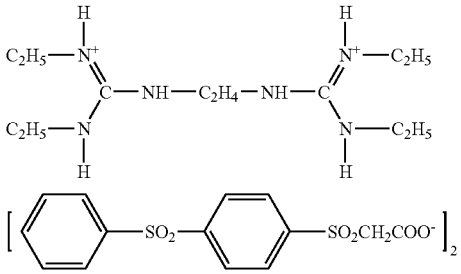

Cyanine dye-1

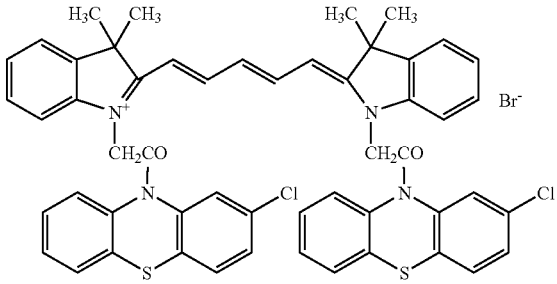

Compound 1 that is one-electron-oxidized to provide a one-electron oxidation product which releases one or more electrons

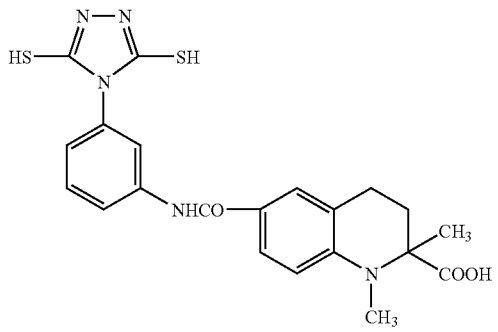

Compound 2 that is one-electron-oxidized to provide a one-electron oxidation product which releases one or more electrons

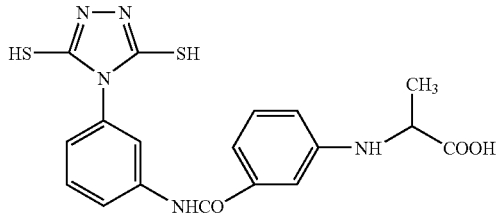

Compound 3 that is one-electron-oxidized to provide a one-electron oxidation product which releases one or more electrons

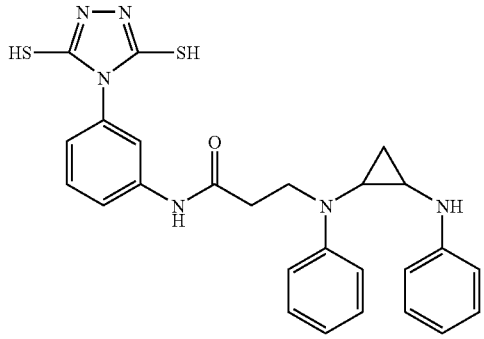

Compound 1 having adsorptive group and reducing group

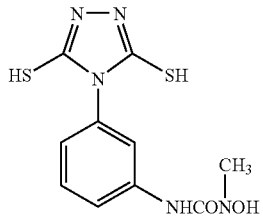

Compound 2 having adsorptive group and reducing group

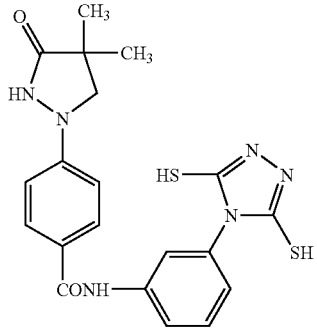

Reducing agent-1

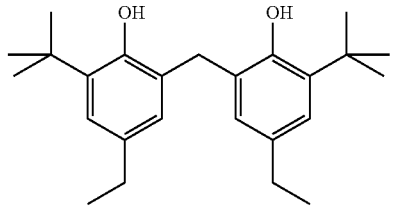

Reducing agent-2

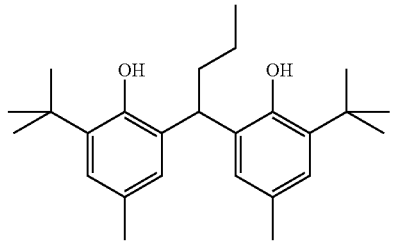

Organic polyhalogen compound-1

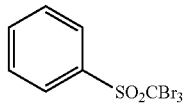

Organic polyhalogen compound-2

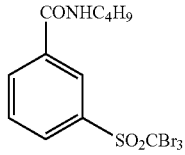

Mercapto compound-1

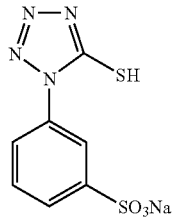

Mercapto compound-2

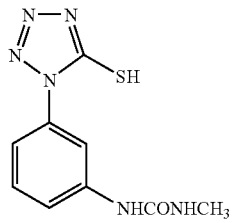

-continued

Phthalazine compound-1

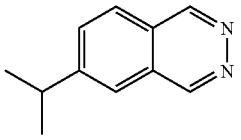

Development accelerator-1

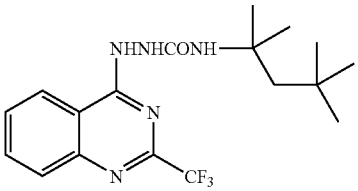

Development accelerator-2

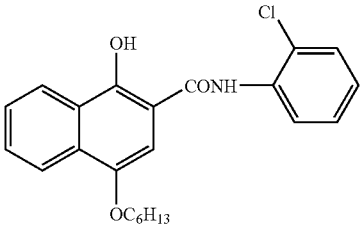

(F-1)

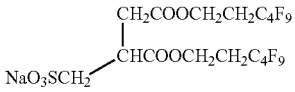

(F-2)

Mixture of

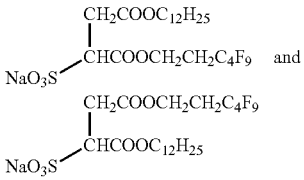

4. Evaluation of Photographic Properties

1) Preparation

The obtained sample was cut into a half-cut size (43 cm in length×35 cm in width), and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-1}$.

2) Imagewise Exposure and Thermal Development

To each sample, imagewise exposure and thermal development (the apparatus was modified so that the time period for thermal development could be changed by 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation of an obtained image was performed with a densitometer.

Measurement of gloss degree of unprocessed sample No. 101 was performed with respect to 20 degree mirror surface gloss defined in JIS K7105 using a glossmeter VG 2000 (trade name, produced by Nippon Denshoku Industries., Ltd). As a result, the gloss degree of sample No. 101 was 95.

3) Evaluation Condition (Photographic Properties)

Fog: Fog is expressed in terms of a density of the unexposed portion.

Sensitivity: Sensitivity is the inverse of the exposure value giving a density of 1.2. The sensitivities are shown in relative value, detecting the sensitivity of Sample No. 101 to be 100.

Dmax: Dmax is a saturated maximum density obtained with an increasing exposure value.

(Image Storability to Heat in a Dark Condition)

The sample was subjected to exposure to give a density of 2.0 and thermal development. Thereafter, a physiological sodium chloride solution was coated on a part of the processed sample so that the concentration of sodium chloride became $2.8 \times 10^{-3}$ mol/$m^2$. After storing the sample in a condition of 50° C. and 50RH % for one day, the color tone of the coated portion and the color tone of the uncoated portion were compared.

<Evaluation Criteria>

◎: No difference in color tone is seen between the coated portion and the uncoated portion.

○: Slight difference in color tone between the coated portion and the uncoated portion is seen, but negligible level.

Δ: Slight difference in density between the coated portion and the uncoated portion is seen, but negligible level.

×: Apparent difference in density between the coated portion and the uncoated portion is seen, and not allowable level for practical use (Image Storability to Light Irradiation)

The portion near to the portion having minimum density on the side having thereon the image forming layer of the samples prepared above was coated with a small amount of a physiological sodium chloride solution, and then pasted up to the inside of a window exposed directly to sunlight and left to stand for one month. Thereafter, the images of the coated portion and the uncoated portion were evaluated by visual observation and classified into the following criteria.

<Evaluation Criteria>

◎: No difference is seen.

○: Slight difference in color tone is seen, but negligible level

Δ: Some difference in color tone is seen at the image portion, and allowable level for practical use.

×: Discoloration and stain are seen in the coated portion, and not allowable level for practical use.

(Resistance to Scratch after Processing)

The samples subjected to exposure to give a density of 3.0 and thermal development were prepared and the image surfaces thereof were rubbed by a commercial nylon scrubbing pad at a scrubbing speed of 1 cm per second with a load of 20 g/$cm^2$. After rubbing thereto, the film surfaces were visually observed and the number of the scratched trace was counted. The smaller is the number, the better is the resistance.

4) Results

The obtained results are shown in Table 5.

It is apparent from Table 5 that the samples, in which an organic silver salt that is different from the organic silver salt included in the image forming layer is incorporated in the first layer of the surface protective layers, attain improvement in image storability and scratch after processing while maintaining the photographic properties. Moreover, the use of silver behenate, which is the same as that used for the image forming layer, in the first layer of the surface protective layers does not solve the task of the present invention and results in similar performances obtained in the samples including no organic silver salts in the non-photosensitive layer.

TABLE 5

| Sample No. | Intermediate Layer B: Latex | Intermediate Layer B: Ratio of Latex (%) | Organic Silver Salt included in First Layer of Surface Protective Layers: Organic Silver Salt | Organic Silver Salt included in First Layer of Surface Protective Layers: Addition Amount (Ag-mol/m$^2$) | Photographic Properties: Fog | Photographic Properties: Sensitivity |
|---|---|---|---|---|---|---|
| 101 | Latex A | 65 | Silver salt of benzotriazole compound | $1.3 \times 10^{-3}$ | 0.20 | 100 |
| 102 | Latex A | 55 | Silver salt of benzotriazole compound | $1.3 \times 10^{-3}$ | 0.20 | 101 |
| 103 | Latex A | 45 | Silver salt of benzotriazole compound | $1.3 \times 10^{-3}$ | 0.20 | 102 |
| 104 | Latex A | 35 | Silver salt of benzotriazole compound | $1.3 \times 10^{-3}$ | 0.20 | 102 |
| 105 | Latex A | 65 | — | — | 0.20 | 102 |
| 106 | Latex A | 65 | Silver behenate | $1.3 \times 10^{-3}$ | 0.22 | 105 |
| 107 | Latex A | 65 | Silver laurate | $1.3 \times 10^{-3}$ | 0.22 | 105 |
| 108 | SBR (TP-1) | 65 | Silver salt of benzotriazole compound | $1.3 \times 10^{-3}$ | 0.20 | 99 |
| 109 | SBR (TP-1) | 65 | Silver behenate | $1.3 \times 10^{-3}$ | 0.22 | 99 |

| Sample No. | Photographic Properties Dmax | Image Storability to Heat under Dark Condition | Image Storability to Light Irradiation | Scratch after Processing (number) | Note |
|---|---|---|---|---|---|
| 101 | 4.3 | ◎ | ○ | 1 | Invention |
| 102 | 4.3 | ◎ | ○ | 1 | Invention |
| 103 | 4.3 | X | Δ | 2 | Comparative |
| 104 | 4.3 | X | X | 2 | Comparative |
| 105 | 4.3 | X | X | 4 | Comparative |
| 106 | 4.4 | X | X | 4 | Comparative |
| 107 | 4.4 | ○ | ○ | 1 | Invention |
| 108 | 4.3 | ◎ | ◎ | 1 | Invention |
| 109 | 4.3 | X | X | 4 | Comparative |

Example 2

1) Preparations of Sample

Sample Nos. 201 to 205 were prepared similar to sample No. 101 of Example 1 except that adding the fluorine atom-containing polymer latex shown in Table 6 to the coating solution for the second layer of surface protective layers.

2) Performance Evaluation

The prepared samples were evaluated similar to Example 1, and the obtained results are shown in Table 6.

As a result, effects similar to Example 1 are obtained by using the fluorine atom-containing polymer latex in the second layer of the surface protective layers, and further, improvement in scratch resistance after processing is attained.

TABLE 6

| Sample No. | Fluorine Atom-containing Polymer Latex: No. | Fluorine Atom-containing Polymer Latex: Addition Amount (g/m$^2$) | Photographic Properties: Fog | Photographic Properties: Sensitivity | Photographic Properties: Dmax | Image Storability to Heat under Dark Condition | Image Storability to Light Irradiation | Scratch after Processing (number) | Note |
|---|---|---|---|---|---|---|---|---|---|
| 201 | FL-1 | 0.10 | 0.2 | 100 | 4.3 | ◎ | ○ | 0 | Invention |
| 202 | FL-2 | 0.10 | 0.2 | 102 | 4.3 | ◎ | ○ | 0 | Invention |
| 203 | FL-3 | 0.10 | 0.2 | 99 | 4.3 | ◎ | ○ | 0 | Invention |
| 204 | FL-4 | 0.10 | 0.2 | 101 | 4.3 | ◎ | ○ | 0 | Invention |
| 205 | FL-5 | 0.10 | 0.2 | 98 | 4.3 | ◎ | ○ | 0 | Invention |

What is claimed is:

1. A photothermographic material comprising, on at least one side of a support, an image forming layer comprising at least a photosensitive silver halide, a first non-photosensitive organic silver salt, a reducing agent, and a binder, and a non-photosensitive layer comprising a second non-photosensitive organic silver salt that is different from the first non-photosensitive organic silver salt on the same side of the support as the image forming layer and farther from the support than the image forming layer, wherein the photothermographic material further comprises a non-photosensitive intermediate layer between the image forming layer and the non-photosensitive layer, and 50% by weight or more of a binder in the non-photosensitive intermediate layer is a polymer latex.

2. The photothermographic material according to claim 1, wherein the first non-photosensitive organic silver salt comprises a silver salt of a fatty acid, and the second non-photosensitive organic silver salt comprises a silver salt of a nitrogen-containing heterocyclic compound.

3. The photothermographic material according to claim 2, wherein the silver salt of a nitrogen-containing heterocyclic compound comprises a silver salt of a benzotriazole compound.

4. The photothermographic material according to claim 1, wherein a ratio of an amount of the second non-photosensitive organic silver salt relative to an amount of the first non-photosensitive organic silver salt is from 0.5 mol % to 50 mol % on the basis of silver molar ratio.

5. The photothermographic material according to claim 1, wherein 50% by weight or more of the binder in the image forming layer is a polymer latex.

6. The photothermographic material according to claim 1, wherein the photothermographic material further comprises, on the side of the support having thereon the image forming layer, a non-photosensitive outermost layer that is different from the non-photosensitive layer.

7. The photothermographic material according to claim 6, wherein 50% by weight or more of a binder in the non-photosensitive outermost layer is a hydrophilic polymer.

8. The photothermographic material according to claim 7, wherein the hydrophilic polymer comprises gelatin or a gelatin derivative.

9. The photothermographic material according to claim 1, wherein the photothermographic material comprises a fluorine atom-containing polymer latex having a monomer component represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 to 41 fluorine atoms; p represents 1 or 2; L represents a linking group containing 1 to 12 carbon atoms; and R represents a hydrogen atom or a methyl group.

10. The photothermographic material according to claim 9, wherein the fluorine atom-containing polymer latex is incorporated in the non-photosensitive outermost layer.

* * * * *